US012104477B1

(12) United States Patent
Greska

(10) Patent No.: US 12,104,477 B1
(45) Date of Patent: Oct. 1, 2024

(54) WELL LOCKOUT AND AUTOMATION SYSTEMS AND METHODS

(71) Applicant: Cactus Wellhead, LLC, Houston, TX (US)

(72) Inventor: Brenton J. Greska, Katy, TX (US)

(73) Assignee: Cactus Wellhead, LLC, Houston, TX (US)

( * ) Notice: Subject to any disclaimer, the term of this patent is extended or adjusted under 35 U.S.C. 154(b) by 0 days.

(21) Appl. No.: 18/603,738

(22) Filed: Mar. 13, 2024

Related U.S. Application Data

(60) Provisional application No. 63/451,865, filed on Mar. 13, 2023.

(51) Int. Cl.
*E21B 43/26* (2006.01)
*E21B 34/02* (2006.01)
*E21B 34/16* (2006.01)

(52) U.S. Cl.
CPC ..... *E21B 43/2607* (2020.05); *E21B 34/02* (2013.01); *E21B 34/16* (2013.01)

(58) Field of Classification Search
CPC ..... E21B 43/2607; E21B 34/02; E21B 34/16
See application file for complete search history.

(56) References Cited

U.S. PATENT DOCUMENTS 9,068,432 B2 6/2015 Chapman
9,103,191 B2 8/2015 Chapman
9,512,706 B2 12/2016 Chapman
9,540,920 B2 1/2017 Chapman et al.
9,641,811 B2 5/2017 Jose et al.
10,062,044 B2 8/2018 Hildebrand et al.
10,094,213 B1 * 10/2018 Guijt ..... E21B 47/00
10,246,984 B2 4/2019 Payne et al.
10,289,125 B2 5/2019 Imel et al.
10,392,918 B2 8/2019 Harkless et al.
10,408,267 B2 9/2019 Omoto et al.
10,626,714 B2 4/2020 Foubert et al.
10,753,165 B1 8/2020 Fischer et al.
10,794,153 B2 10/2020 Meehan et al.
10,851,638 B2 12/2020 Payne et al.
10,871,045 B2 12/2020 Fischer et al.
10,982,498 B1 4/2021 Fischer et al.
(Continued)

*Primary Examiner* — Ramesh B Patel
(74) *Attorney, Agent, or Firm* — Conrad J. Hsu

(57) ABSTRACT

Techniques for coordinating performance of operations in a well system including receiving, using a central controller, a request to perform a next operation associated with a first operator that includes changing well system equipment from a current equipment state to a target equipment state from a first operator device, determining, using the central controller, whether completion confirmation of a preceding operation associated with a second operator has been received from a second operator device, in response to determining that the completion confirmation of the preceding operation associated with the second operator has not been received, blocking, using the central controller, the first operator from performing the next operation from the first operator device, and in response to determining that the completion confirmation of the preceding operation associated with the second operation has been received, permitting, using the central controller, performance of the next operation associated with the first operator.

20 Claims, 6 Drawing Sheets

(56) References Cited

U.S. PATENT DOCUMENTS 10,995,589 B2 5/2021 Funkhouser et al.
11,143,569 B2 10/2021 Neal, III et al.
11,156,044 B2 10/2021 Fischer et al.
11,286,736 B2 3/2022 Fischer et al.
11,371,330 B2 6/2022 Christie et al.
11,401,779 B2 8/2022 Kuehn et al.
11,473,381 B2 10/2022 Fischer et al.
11,480,027 B2 10/2022 Beason et al.
11,560,770 B2 1/2023 Kuehn et al.
11,606,695 B2 * 3/2023 Ostrovsky ..... G06F 8/65
11,639,653 B2 5/2023 Bolen et al.
11,681,262 B2 * 6/2023 Ray ..... G05B 13/0265 700/275
11,708,733 B2 7/2023 Fischer et al.
11,713,894 B2 * 8/2023 Rigg ..... F24F 11/47 700/276
11,727,322 B2 8/2023 Meehan et al.
11,746,635 B1 9/2023 Kabrich et al.
11,753,890 B2 * 9/2023 Chapman ..... E21B 47/12 166/385
11,753,911 B1 * 9/2023 Kabrich ..... E21B 34/02 166/250.01
11,767,748 B2 9/2023 Payne et al.
11,808,139 B2 11/2023 Kabrich et al.
11,814,913 B2 11/2023 Ghanmi et al.
11,814,947 B2 11/2023 Stark et al.
11,859,480 B2 1/2024 Kabrich et al.
2017/0308065 A1 * 10/2017 Yamaguchi ..... G05B 19/41865
2018/0024528 A1 * 1/2018 Hodne ..... G05B 19/409 700/83
2018/0266217 A1 * 9/2018 Funkhouser ..... E21B 21/10
2018/0320476 A1 * 11/2018 McEvoy ..... E21B 34/02
2020/0208747 A1 * 7/2020 Babineaux ..... E21B 33/038
2020/0332954 A1 * 10/2020 Babineaux ..... E21B 41/00
2021/0406792 A1 12/2021 Bhardwaj et al.
2022/0025753 A1 1/2022 Hiedari et al.
2022/0027538 A1 7/2022 Walters et al.
2022/0220837 A1 * 7/2022 Greska ..... E21B 43/2607
2022/0268141 A1 8/2022 Krupa et al.
2022/0316307 A1 * 10/2022 Curry ..... E21B 43/2607
2023/0003113 A1 * 1/2023 Alharbi ..... G06N 3/084
2023/0078738 A1 3/2023 Al Daif
2023/0235643 A1 * 7/2023 Bushman ..... E21B 43/2607 137/605
2023/0287760 A1 9/2023 Kabrich et al.
2023/0383644 A1 11/2023 Duncan
2023/0417116 A1 12/2023 Duncan et al.
2023/0417118 A1 * 12/2023 Chen ..... E21B 33/068

* cited by examiner

WELL LOCKOUT AND AUTOMATION SYSTEMS AND METHODS

CROSS-REFERENCE

The present disclosure claims priority to and benefit of U.S. Provisional Application No. 63/451,865, entitled "REMOTE LOCKOUT SYSTEM FOR FRAC VALVE OPERATIONS," filed Mar. 13, 2023, which is incorporated herein by reference in its entirety for all purposes.

BACKGROUND

The present disclosure generally relates to well systems and, more particularly, to techniques for properly and efficiently coordinating operations performed by different groups of operators in a well system, for example, to facilitate improving operational efficiency of the well system.

Often, to produce fluid, such as oil and/or gas, from a well in a well system, multiple different groups of operators may need to perform operations around the well system. For example, a well owner's operator may be responsible for performing a fluid production operation to produce fluid from the wellbore of a well for storage, transport, and/or processing. However, to facilitate improving production of the well, a fracturing operator may be responsible for performing a hydraulic fracturing operation to hydraulically fracture the formation surrounding the wellbore.

In fact, to perform their responsibilities, different operator groups may need to operate the same equipment in different manners. For example, to perform a hydraulic fracturing operation on a well, a fracturing operator may need an injection wing valve of a corresponding fracturing tree to be in its open state and a production wing valve of the fracturing tree to be in its closed state. On the other hand, to perform a fluid production operation, a well owner's operator may need the injection wing valve to be in its closed state and the production wing valve to be in its open state. Additionally, to actually improve the production of the well, the hydraulic fracturing operation may need to be performed before the well owner's operator performs the fluid production operation. Accordingly, coordination between different operator groups around a well system potentially creates a bottleneck that limits operational efficiency of the well system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a method of coordinating performance of operations in a well system includes receiving, using a central controller of a control sub-system, a request to perform a next operation associated with a first operator that includes changing well system equipment from a current equipment state to a target equipment state from a first operator device that is assigned to and associated with the first operator, determining, using the central controller, whether completion confirmation of a preceding operation associated with a second operator has been received from a second operator device that is assigned to and associated with the second operator, in response to determining that the completion confirmation of the preceding operation associated with the second operator has not been received from the second operator device, blocking, using the central controller, the first operator from performing the next operation to change the well system equipment from the current equipment state to the target equipment state from the first operator device, and in response to determining that the completion confirmation of the preceding operation associated with the second operation has been received from the second operator device, permitting, using the central controller, performance of the next operation associated with the first operator at least in part by enabling the well system equipment to be changed from the current equipment state to the target equipment state from the first operator device.

In another embodiment, a well system includes well system equipment, a power sub-system that selectively powers the well system equipment, and a control sub-system communicatively coupled to the power sub-system. The control sub-system includes a first operator device that is to be assigned to and associated with a first operator, in which the first operator device enables the first operator to request performance of a next operation in the well system that includes changing the well system equipment from a current equipment state to a target equipment state, a second operator device that is to be assigned to and associated with a second operator, in which the second operator device enables the second operator to confirm completion of a preceding operation in the well system, and a central controller communicatively coupled to the first operator device and the second operator device via a communication network, in which the central controller is permits performance of the next operation associated with the first operator only after the second operator has confirmed completion of the preceding operation.

In a further embodiment, a tangible, non-transitory, computer-readable media stores instructions executable by processing circuitry of a control sub-system in a well system. The instruction include instructions to instruct, using the processing circuitry, the well system to transition a fluid valve from a first current state to a first target state, determine, using the processing circuitry, whether sensor feedback received from an equipment sensor corresponding with the fluid valve indicates that the fluid valve has achieved the first target state, determine, using the processing circuitry, whether a sensor timeout associated with the equipment sensor of the fluid valve has elapsed, and at an earlier of the sensor feedback indicating that the fluid valve has achieved the first target state and the sensor timeout elapsing, instruct, using the processing circuitry, the well system to transition other well system equipment from a second current state to a second target state.

DETAILED DESCRIPTION

Figure 1:
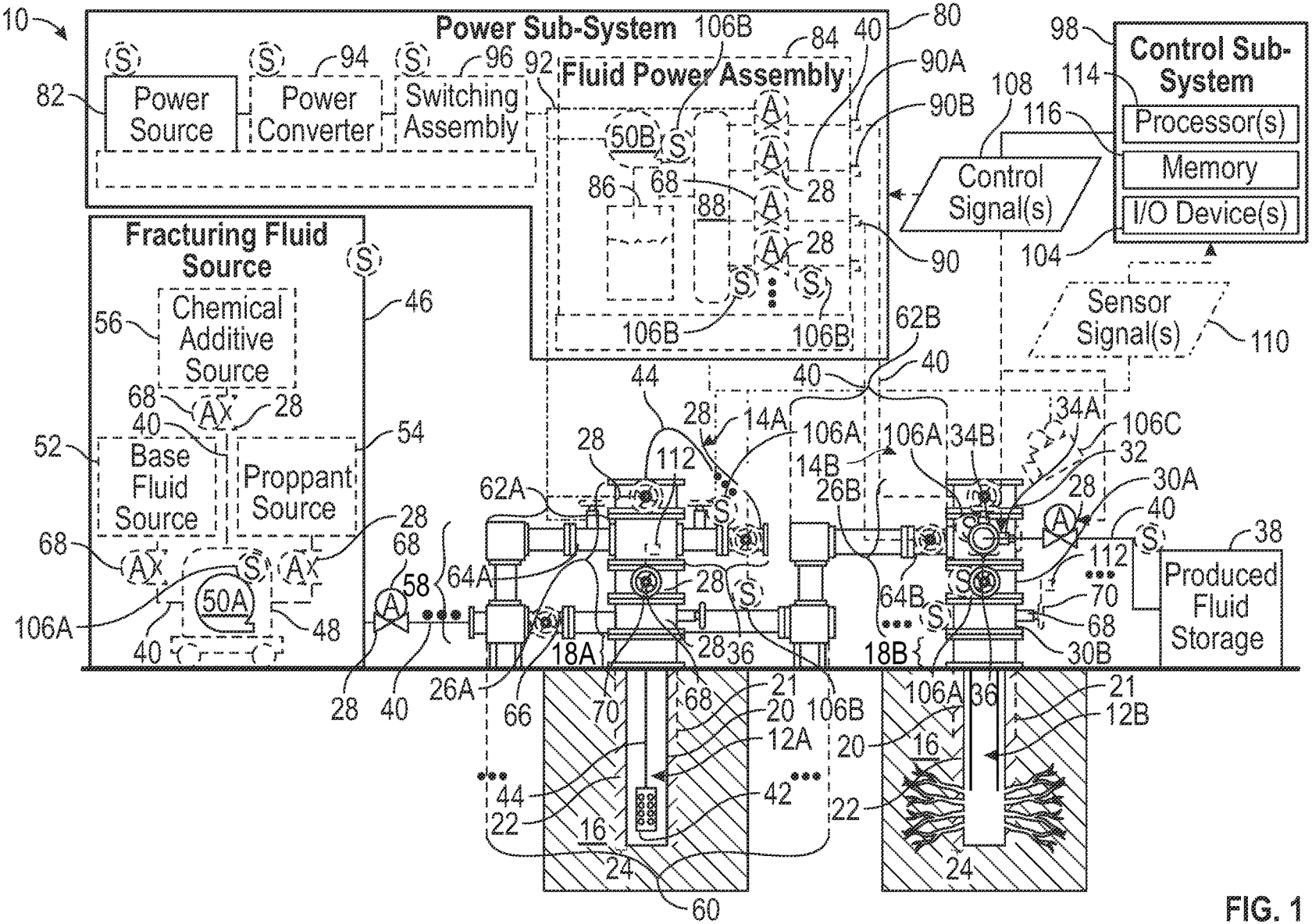
FIG. 1 is a block diagram of an example of a well system, in accordance with an embodiment of the present disclosure.

One or more specific embodiments of the present disclosure will be described below with reference to the figures. Wherever possible, like or identical reference numerals are used in the figures to identify common or the same features. The figures are not necessarily to scale. In particular, certain features and/or certain views of the figures may be shown exaggerated in scale for purposes of clarification. As used herein, the term "coupled" or "coupled to" may indicate establishing either a direct or indirect connection and, thus, is not limited to either unless expressly referenced as such.

The present disclosure generally relates to well systems that operate to produce fluid, such as oil and/or gas, from a well. Due to its complexity, the overall process of producing fluid from a well often involves multiple different parties and, thus, corresponding operator groups that have different responsibilities. For example, a drilling operator may be responsible for drilling a wellbore, an installation operator may be responsible for casing the wellbore, a tool operator may be responsible for perforating the casing and the formation surrounding the wellbore, a fracturing operator may be responsible for hydraulically fracturing the formation surrounding the wellbore, and a well owner's operator may be responsible for producing fluid from the wellbore for storage, transport, and/or processing (e.g., refinement).

In fact, although different operations may be serially performed on a well, to facilitate improving operational efficiency, different operator groups may nevertheless operate at least partially in parallel. For example, although a hydraulic fracturing operation may be performed on a well after a perforation operation, a fracturing operator may begin preparing (e.g., mixing and/or blending) fracturing fluid while a tool operator is still in the process of perforating the casing and the surrounding formation.

Moreover, to accomplish their responsibilities, different operator groups may need to operate the same equipment in different manners. For example, to enable a perforation (i.e., downhole) tool to be disposed within a corresponding wellbore during a perforation operation, a tool operator may need a swab valve at the top of a fracturing tree to be in its open state. On the other hand, to prevent fracturing fluid from inadvertently leaking to the surrounding environment during a hydraulic fracturing operation, a fracturing operator may need the swab valve to be in its closed state. In fact, closing the swab valve while the perforation tool is still disposed within the wellbore may result in the swab valve inadvertently trapping or even cutting a conveyance line that connects the perforation tool to the surface, thereby necessitating corrective operations, such as fishing the perforation tool out of the wellbore, before normal operation can resume. In other words, at least in some instances, inappropriate coordination between different operator groups around a well system may potentially limit operational efficiency (e.g., production time) of the well system.

Accordingly, to facilitate improving operational efficiency, the present disclosure provides techniques for properly and efficiently coordinating different operator groups around a well system, for example, to enable a fracturing operator and a tool operator to operate at least partially in parallel while reducing the likelihood of fracturing operations and perforation operations inadvertently disrupting one another. To facilitate controlling and, thus, coordinating operation, a well system generally includes a control sub-system. In particular, the control sub-system may be communicatively coupled to well system equipment, such as one or more fluid valves, to enable the control sub-system to instruct the well system equipment to execute control actions, for example, in addition to one or more sensors to enable the control sub-system to determine operational parameters of the well system. Merely as an illustrative, non-limiting example, a control sub-system may instruct a valve actuator to transition a fluid valve from its current valve state to a target valve state (e.g., fully open state, fully closed state, or intermediate state), for example, in addition to receiving sensor feedback indicative of whether the fluid valve has achieved its target state.

Additionally, to facilitate coordinating different operator groups around a well system, a control sub-system may be distributed between multiple operator devices, which are each assigned to and associated with a different operator group, and a central controller, which is communicatively coupled to the operator devices. For example, to facilitate coordinating fracturing operations and perforation operations, a central controller may be communicatively coupled to a first operator device, which is assigned to and associated with a representative tool operator, as well as a second operator device, which is assigned to and associated with a representative fracturing operator.

Generally, an operator device that is assigned to and associated with an operator may include an electronic display, which enables the control sub-system to present information to the operator, and a user input device (e.g., buttons and/or touch sensors), which enables the operator to provide user inputs to the control sub-system. For example, the electronic display of an operator device may present a current valve state of a fluid valve and/or a prompt for response. Additionally or alternatively, the user input device of an operator device may enable an operator to request that the fluid valve change to a different valve state and/or to respond to the prompt. Accordingly, to facilitate coordinating performance of a preceding operation associated with a first operator and a subsequent (e.g., next) operation associated with a second operator, in some embodiments, the second operator may request to perform their next operation (e.g., after completing their own preceding operation) via their second operator device and, in response, the control sub-system may request approval from the first operator via their first operator device for the second operator to perform their subsequent operation and, until approval from the first operator is received, maintain a lockout on the second operator to block the second operator from performing their subsequent operation via their second operator device.

However, at least in some instances, different operator groups that work on the same well may only have a contractual relationship with the owner of the well. For example, the owner of a well may have a contractual relationship with a tool operator and a fracturing operator, but the tool operator and the fracturing operator may not have a contractual relationship with one another. In other words, in such instances, different operator groups working on the same well may be independent third parties relative to one another and, thus, do not have the authority to approve or authorize the performance of an operation by another operator group.

Accordingly, to facilitate coordinating performance of a preceding operation associated with a first operator and a subsequent (e.g., next) operation associated with a second operator, in other embodiments, a control sub-system may maintain a lockout on the second operator to block the second operator from performing their subsequent operation until the first operator has confirmed completion of their preceding operation. In particular, in some such embodiments, the control sub-system may simply wait for the first operator to input their completion confirmation via their first operator device. However, to facilitate expediting the transition between different operations, in other such embodiments, the control sub-system present the first operator with a prompt to confirm completion of their preceding operation via their first operator device, for example, in response to receiving a request from the second operator to perform their next well operation and/or in accordance with an operation schedule.

Additionally, for traceability purposes, in some embodiments, a control sub-system may log or otherwise track received completion confirmations relative to performance of subsequent operations via an operations log, for example, in addition to request finalizations or re-confirmations. Merely as an illustrative, non-limiting example, a control sub-system may log that a tool operator confirmed completion of a perforation operation at a first time and that a fracturing operator began performance of a hydraulic fracturing operation at a second time after the first time, for example, and that the fracturing operator finalized or re-confirmed their request to perform the hydraulic fracturing operation at a third time between the first time and the second time. Accordingly, if a swab valve of a fracturing tree were to inadvertently close on a conveyance line of a perforation tool during the hydraulic fracturing operation, the operation log can be referenced to show that the perforation tool should have been out of a corresponding wellbore and, thus, the conveyance line should have been removed from the fracturing tree by the time the hydraulic fracturing operation was started.

In any case, after receiving completion confirmation from an associated operator of a preceding operation, a control sub-system may permit performance of an operator's subsequent (e.g., next) operation. In particular, while an operator is permitted to perform an operation, in some embodiments, a control sub-system may remove the lockout from the operator to enable the operator to control individual equipment from their operator device to perform individual control action steps in the operation, for example, after also receiving finalization or re-confirmation from the operator of their request to perform the operation (e.g., to enable the operator to cancel their request). Merely as an illustrative non-limiting example, when permitted to perform a hydraulic fracturing operation, a control sub-system may enable a fracturing operator to instruct a well system to transition a swab valve of a corresponding fracturing tree to its closed state via their operator device.

However, at least in some instances, an operation in a well system may include multiple control action steps that need to be sequentially performed. For example, to perform a hydraulic fracturing operation, a swab valve of a fracturing tree may need to be transitioned to its closed state before an injection wing valve of the fracturing tree is transitioned to its open state. In fact, opening the injection wing valve while the swab valve is still open may result in hydraulic fluid inadvertently leaking to the surrounding environment instead of fracturing the formation surrounding a corresponding wellbore, thereby necessitating corrective operations, such as environmental cleanup, before normal operation can resume. In other words, at least in some instances, inappropriate coordination between different control action steps in an operation, which may occur even if performed by the same operator, may potentially limit operational efficiency (e.g., production time) of a well system.

Accordingly, to facilitate improving well system operational efficiency, in other embodiments, a control sub-system may at least partially automate performance of one or more control action steps within an operation, for example, to reduce the likelihood of operator error. In particular, while performance of an operation is permitted, in some such embodiments, instead of permitting an operator to control individual equipment to perform individuals control steps in the operation, a control sub-system may maintain the operator locked out and merely enable the operator to request performance of the operation as a whole and, in response to such a request, may automatically instruct well system equipment to operate in accordance with the operation for example, after also receiving finalization or re-confirmation from the operator of their request to perform the operation (e.g., to enable the operator to cancel their request). Merely as an illustrative, non-limiting example, when performance of a hydraulic fracturing operation is requested and permitted, a control sub-system may automatically instruct a well system to transition a swab valve of a fracturing tree to its closed state and, after the swab valve has achieved its target closed state, automatically instruct the well system to transition an injection wing valve of the fracturing tree to its open state.

To facilitate further improving well system operational efficiency, in some embodiments, a control sub-system may automatically attempt to perform a next operation associated with an operator in response to the operator confirming completion of their directly preceding operation. For example, when a fracturing operator confirms completion of a fluid preparation operation, a control sub-system may automatically attempt to perform a hydraulic fracturing operation.

In any case, when an operation includes multiple control action steps that need to be sequentially performed, a control sub-system may need to coordinate performance of the various control action steps to automate performance of the operation. To facilitate efficient coordination and control, in some embodiments, a control sub-system may be communicatively coupled to equipment sensors that feedback operational parameters of corresponding equipment. For example, a valve sensor may feedback an indication of the current valve state of a corresponding fluid valve to enable the control sub-system to determine whether the fluid valve is currently in a fully open state, a fully closed state, or an intermediate valve state between the fully open state and the fully closed state and, thus, whether the fluid valve is currently in its target valve state.

However, at least in some instances, a faulty equipment sensor may feedback improper operational parameters or cease providing operational parameter feedback all together. For example, a faulty valve sensor may indicate that a corresponding fluid valve has not achieved its target valve state when the fluid valve has in fact achieved its target valve state.

Accordingly, to facilitate reducing the likelihood of inadvertently holding up performance of an operation simply due to a faulty equipment sensor, in some embodiments, a control sub-system may utilize a sensor timeout for an equipment sensor. In particular, a sensor timeout associated with an equipment sensor may be set based at least in part on the amount of time corresponding equipment is expected to take to reach a target state. For example, a sensor timeout associated with a valve sensor may be set to match or slightly longer than the expected time for changing a corresponding fluid valve from its current valve state to a target valve state. Alternatively, to more conservatively account for unforeseen (e.g., environmental and/or equipment) variations, a sensor timeout associated with a valve sensor may be set based on the expected time for changing a corresponding fluid valve from its fully open state to its fully closed state or vice versa.

As such, when a sensor timeout associated with an equipment sensor has been reached but the equipment sensor indicates that corresponding equipment has not yet reached its target equipment state for a preceding control action step in an operation, a control sub-system may presume that the equipment has reached its target state and begin performance of a next control action step in the operation, for example, in addition identifying that the equipment sensor is potentially faulty once achievement of the target state is secondarily confirmed by an operator and/or via analysis of fluid parameter sensor feedback. In this manner, as will be described in more detail below, the present disclosure provides techniques for improving automated coordination and performance of sequential control action steps in an operation and, thus, well system operational efficiency (e.g., production time), for example, by enabling the operation to be completed faster and/or with fewer improper work stoppages. Additionally, as will be described in more detail below, the present disclosure provides techniques for improving coordination between different operator groups that have differing responsibilities in a well system, which, at least in some instances, may facilitate improving well system efficiency, for example, by enabling faster switching between well operations performed by different operator groups and/or reducing the need for corrective action while accounting for the actual relationship between the different operator groups.

To help illustrate, an example of a well system 10 is shown in FIG. 1. As in the depicted example, to facilitate forming (e.g., drilling) a wellbore 12 of a well 14 in a surrounding formation 16, a well system 10 may generally include a wellhead 18 secured over the wellbore 12. In particular, in the depicted example, the well system 10 includes a first wellhead 18A secured over a first wellbore 12A of a first well 14A and a second wellhead 18B secured over a second wellbore 12B of a second well 14B.

However, it should be appreciated that the depicted example is merely intended to be illustrative and not limiting. In particular, in other embodiments, a well system 10 may include a single well 14 and, thus, a single wellhead 18. Alternatively, in other embodiments, a well system 10 may include more than two (e.g., three, four, or more) wells 14 and, thus, more than two (e.g., three, four, or more) wellheads 18.

In any case, as depicted, a wellhead 18 on a well 14 may generally support and suspend a casing 20 within a corresponding wellbore 12 to facilitate fluidly isolating the wellbore 12 from surrounding formations 16 as well as structurally supporting the wellbore 12. As in the depicted example, to facilitate improving fluid isolation and/or structural support provided by a casing 20, in some embodiments, cement 22 may be found in an annulus surrounding the casing 20, for example, between the casing 20 and the surrounding formation 16 and/or between the casing 20 and an outer casing 20. In addition to a casing 20, as in the depicted example, in some embodiments, a wellhead 18 on a well 14 may be secured to and/or or rest on a conductor pipe 21, for example, which is driven into the formation 16 before drilling of a corresponding wellbore 12.

However, it should again be appreciated that the depicted example is merely intended to be illustrative and not limiting. In particular, in other embodiments, a well 14 may not include a conductor pipe 21. Additionally or alternatively, in other embodiments, a well 14 may include multiple casings 20 concentrically secured to and suspended from a wellhead 18, for example, to enable the corresponding wellbore 12 to be cyclically drilled deeper.

In any case, as in the depicted example, to facilitate improving production from a well 14 as well as controlling fluid production from the well 14, a well system 10 may include a fracturing tree 26, which includes multiple fluid valves 28, secured on and fluidly connected to a corresponding wellhead 18. In particular, in the depicted example, the well system 10 includes a first fracturing tree 26 secured on the first wellhead 18A such that a bore of the first fracturing tree 26A is fluidly connected to a bore of the first wellhead 18A and, thus, the first wellbore 12A. Additionally, the well system 10 includes a second fracturing tree 26B secured on the second wellhead 18B such that a bore of the second fracturing tree 26B is fluidly connected to a bore of the second wellhead 18B and, thus, the second wellbore 12B.

However, it should again be appreciated that the depicted example is merely intended to be illustrative and not limiting. In particular, in other embodiments, a wellhead 18 may include one or more of its own fluid valves 28. Additionally, in other embodiments, a well system 10 may include more than two (e.g., three, four, or more) fracturing trees 26, for example, when the well system 10 includes more than two wells 14. Alternatively, in other embodiments, a well system 10 may include a single fracturing tree 26, for example, when the well system 10 includes a single well 14 or when the same fracturing tree 26 is to be used with multiple different wells 14.

In any case, to provide master control over fluid flow into and/or out of a corresponding wellbore 12, as in the depicted example, the fluid valves 28 on a fracturing tree 26 generally include one or more master (e.g., working) valves 30. In particular, in the depicted example, the fracturing trees 26 each includes an upper master (e.g., working) valve 30A and a lower master (e.g., working) valve 30B. Additionally, to provide vertical access to a corresponding wellbore 12, as in the depicted example, the fluid valves 28 on a fracturing tree 26 generally include a swab (e.g., crown and/or working) valve 32 at the top of the fracturing tree 26.

Furthermore, to facilitate producing fluid from and/or injecting fluid into a corresponding wellbore 12, as in the depicted example, the fluid valves 28 on a fracturing tree 26 generally include one or more wing valves 34. In particular, in the depicted example, the fracturing trees 26 each includes a first wing valve 34A and a second wing valve 34B connected in series on a wing valve branch 36 that extends out (e.g., horizontally) from a vertical extent of the fracturing tree 26. Additionally, to facilitate storing produced fluid for transportation and/or processing, as in the depicted example, a wing valve branch 36 of a fracturing tree 26 may be fluidly connected to a production fluid storage (e.g., tank) 38 via one or more fluid valves 28 and one or more fluid conduits 40, such as piping, tubing, or a hose.

However, it should again be appreciated that the depicted example is merely intended to be illustrative and not limiting. In particular, in other embodiments, a fracturing tree 26 may be fluidly connected directly to a produced fluid storage 38 without any other fluid valves 28 connected therebetween. Furthermore, in other embodiments, a fracturing tree 26 may include multiple wing valve branches 36, for example, which extend out in different (e.g., opposite) directions. Additionally or alternatively, in other embodiments, a wing valve branch 36 on a fracturing tree 26 may include a single wing valve 34 or more than two (e.g., three, four, or more) wing valves 34.

In any case, as described above, a casing 20 disposed within a wellbore 12 may fluidly isolate the wellbore 12 from the surrounding formation 16. Accordingly, to enable fluid to flow from a surrounding formation 16 through a corresponding casing 20 into a wellbore 12 and, thus, from the wellbore 12 through a fracturing tree 26 to a produced fluid storage 38, a perforation operation may need to be performed to perforate the casing 20, for example, in addition to the surrounding formation 16 and/or cement 22 formed between the casing 20 and the surrounding formation 16. In particular, as in the depicted example, a perforation operation may be performed in a well 14 using a (e.g., downhole) perforation tool 42, which is disposed within its wellbore 12 and suspended from the surface using a conveyance line 44, such as a wireline, a slickline, or coiled tubing.

Accordingly, to perform a perforation operation in a corresponding wellbore 12, as in the depicted example, the conveyance line 44 of a perforation tool 42 may extend through a fracturing tree 26, for example, after the perforation tool 42 has been inserted through the fracturing tree 26 into the wellbore 12 and before the perforation tool 42 is withdrawn from the wellbore 12 through the fracturing tree 26. In other words, to perform a perforation operation in a corresponding well 14, each working (e.g., swab, crown, and/or master) valve of a fracturing tree 26 may need to be in its open state. In fact, inadvertently closing a working valve of a fracturing tree 26 while a perforation tool 42 is still disposed within a corresponding wellbore 12 may result in the working valve inadvertently trapping or even cutting the conveyance line 44 of the perforation tool 42, which potentially limits operational efficiency (e.g., production time) of the well system 10, for example, due to corrective action, such as fishing the perforation tool 42 out of the wellbore 12, being needed before normal operation can resume.

In any case, as in the depicted example, to facilitate performing a hydraulic fracturing operation and, thus, improving production of a well 14, a well system 10 may supply fracturing fluid from a fracturing fluid source 46 to a corresponding fracturing tree 26. To facilitate supplying fracturing fluid to a fracturing tree 26, as in the depicted example, a fracturing fluid source 46 generally includes a fluid pump 50—namely a fracturing fluid pump 50A.

Additionally, in some embodiments, fracturing fluid may include a base fluid, such as water or methanol, mixed with proppant (e.g., particles), such as sand and/or ceramic beads, and one or more chemical additives, such as scale inhibitors (e.g., ethylene glycol), clay stabilizers (e.g., potassium chloride), corrosion inhibitors (e.g., propargyl alcohol), gelling agents (e.g., guar gum), pH adjustors (e.g., sodium carbonate), foaming agents (e.g., nitrogen gas), or any combination thereof. In some such embodiments, fracturing fluid may be pre-mixed before being transported to a well system 10.

However, in other embodiments, fracturing fluid may be mixed onsite in a well system 10, for example, to facilitate better accounting for (e.g., adaptively adjusting formulation of fracturing fluid for) potential well and/or formation variations. To facilitate mixing fracturing fluid on-site, a fracturing fluid source 46 may include a mixer (e.g., blender) 48 as well as a base fluid source (e.g., tank and/or pump) 52, a proppant source (e.g., tank or hopper) 54, and a chemical additive source (e.g., tank) 56, which are each fluidly connected to the mixer 48 via one or more corresponding fluid conduits 40 and one or more corresponding fluid valves 28. Accordingly, in such embodiments, supply of the base fluid, the proppant, and the chemical additives to the mixer 48 and, thus, the formulation (e.g., composition) of fracturing fluid may be controlled by controlling actuation (e.g., opening) of corresponding fluid valves 28.

However, it should again be appreciated that the depicted example is merely intended to be illustrative and not limiting. In particular, in other embodiments, a fracturing fluid source 46 in a well system 10 may not include a base fluid source 52, a proppant source 54, and/or a chemical additive source 56, for example, when fracturing fluid to be used in the well system 10 is at least partially mixed offsite.

In any case, as in the depicted example, to facilitate distributing fracturing fluid from a fracturing fluid source 46 between multiple different wells 14, in some embodiments, a well system 10 may include a header apparatus 58 fluidly connected between the fracturing fluid source 46 and corresponding fracturing trees 26. In particular, as in the depicted example, to facilitate controlling supply of fracturing fluid from a fracturing fluid source 46 to a header apparatus 58, in some embodiments, a well system 10 may include one or more fluid valves 28 and one or more fluid conduits 40 fluidly connected between the fracturing fluid source 46 and the header apparatus 58.

However, it should again be appreciated that the depicted example is merely intended to be illustrative and not limiting. In particular, in other embodiments, a header apparatus 58 may be fluidly connected directly to a fracturing fluid source 46 without any other fluid valves 28 connected therebetween.

In any case, as in the depicted example, to facilitate selectively distributing fracturing fluid from a fracturing fluid source 46 to multiple wells 14, in some embodiments, a header apparatus 58 may generally include a header trunk 60 and multiple header branches 62, which each fluidly connects the header trunk 60 to a corresponding fracturing tree 26 and includes a fluid valve 28—namely a branch isolating (e.g., isolation) valve 64. In particular, in the depicted example, the header apparatus 58 includes a first header branch 62A, which fluidly connects a bore of the header trunk 60 to a bore of the first fracturing tree 26A and includes a first branch isolating (e.g., isolation) valve 64A disposed therebetween, and a second header branch 62B, which fluidly connects the bore of the header trunk 60 to a bore of the second fracturing tree 26B and includes a second branch isolating (e.g., isolation) valve 64B disposed therebetween.

Additionally, as in the depicted example, in some embodiments, a header trunk 60 of a header apparatus 58 may include one or more trunk isolating (e.g., isolation) valves 66, for example, to facilitate supplying appropriately pressurized fracturing fluid to an upstream fracturing tree 26 with improved efficiency. Merely as an illustrate, non-limiting example, to enable fracturing fluid to be supplied to the second fracturing tree 26B, the trunk isolating valve 66 may be in its open state to enable fracturing fluid to flow to the second header branch 62B. However, when fracturing fluid is to be supplied to the first fracturing tree 26A, the trunk isolating valve 66 may be in its closed state to block the fracturing fluid from flowing to the second header branch 62B to reduce the volume the fracturing fluid needs to fill and, thus, the time it takes to supply appropriately pressured fracturing fluid to the first fracturing tree 26A, for example, as compared to merely closing the second branch isolating valve 64B on the second header branch 62B while leaving the header trunk 60 unimpeded (e.g., trunk isolating valve 66 in its open state). In other words, in such embodiments, a header trunk 60 of a header apparatus 58 may include N−1 trunk isolating valves 66 where N is the number of header branches 62 in the header apparatus 58.

However, it should again be appreciated that the depicted example is merely intended to be illustrative and not limiting. In particular, in other embodiments, a header trunk 60 of a header apparatus 58 may not include a trunk isolating valve 66, for example, when header branches 62 of the header apparatus 58 are sufficiently close together. Additionally, in other embodiments, a header branch 62 of header apparatus 58 may not include a branch isolating valve 64, for example, when the header branch 62 is fluidly connected to a wing valve branch 36 of a corresponding fracturing tree 26 and, thus, a wing valve 34 can be used as a branch isolating valve 64. Alternatively, in other embodiments, a well system 10 may not include a header apparatus 58, for example, when the well system 10 includes a single well 14 or instead includes a zipper apparatus.

In any case, as in the depicted example, to facilitate automating operation thereof, a fluid valve 28 in a well system 10 generally includes an automated valve actuator 68, for example, in addition to a manual valve actuator 70 (e.g., handle or wheel) that enables an operator to manually control (e.g., override) operation of the fluid valve 28. In particular, in some embodiments, an automated valve actuator 68 of a fluid valve 28 may be an electromechanical actuator (e.g., motor) and, thus, adjusts the valve state of the fluid valve 28 when electrical power is supplied thereto. However, in other embodiments, an automated valve actuator 68 of a fluid valve 28 may be a fluid-powered (e.g., hydraulic or pneumatic) actuator and, thus, adjusts the valve state of the fluid valve 28 when pressurized actuation fluid is supplied thereto.

Figure 2:
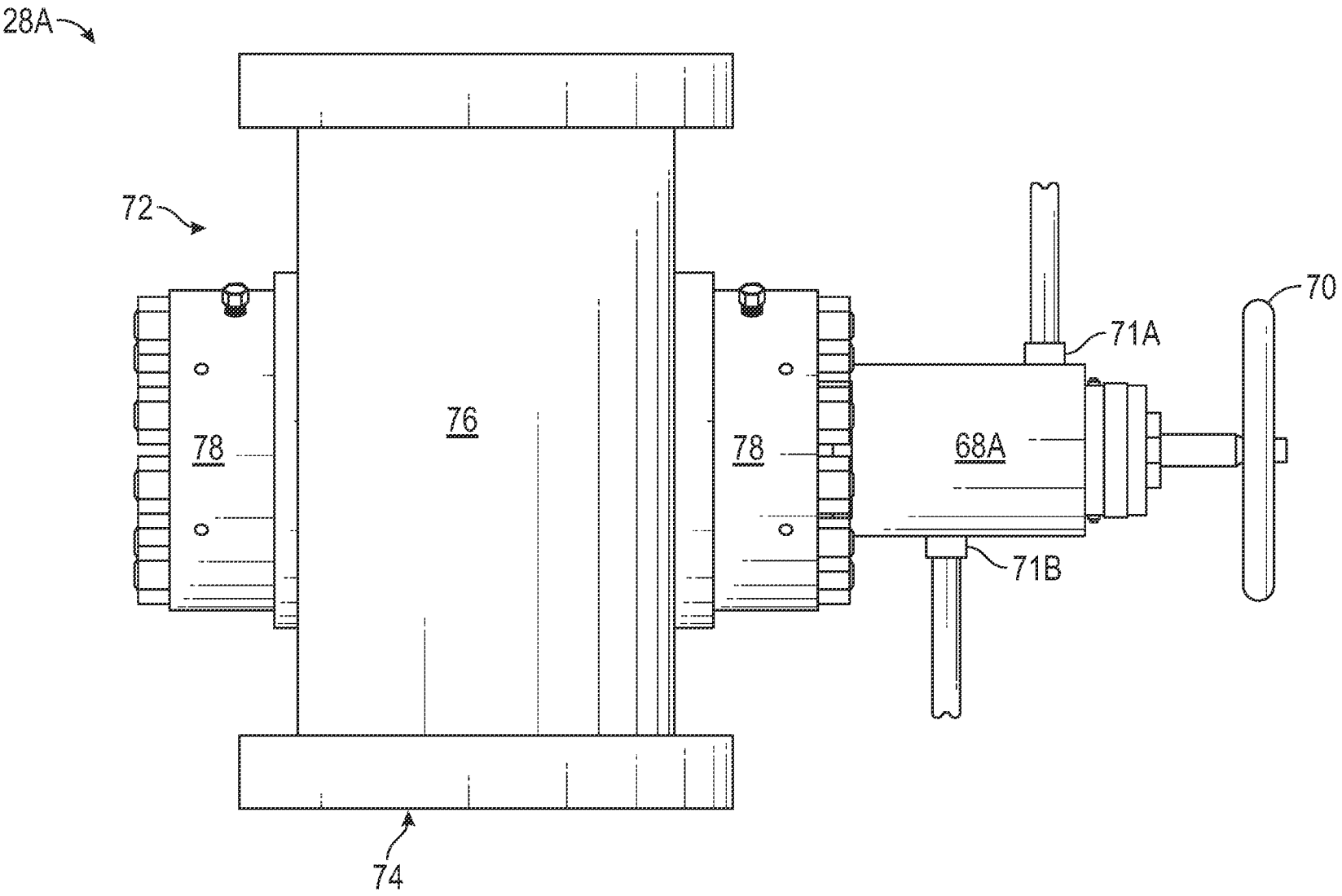
FIG. 2 is a side view of an example of a fluid-powered fluid valve that may be included in the well system of FIG. 1, in accordance with an embodiment of the present disclosure.

To help illustrate, an example of a fluid valve 28A with a fluid-powered (e.g., hydraulic or pneumatic) valve actuator 68A that may be included in a well system 10 is shown in FIG. 2. As in the depicted example, a fluid valve 28 generally includes a valve body 72 that defines a fluid bore 74 through the fluid valve 28. In particular, in the depicted example, the valve body 72 of the fluid valve 28 includes a central spool 76 with side caps 78 secured (e.g., bolted) thereto.

However, it should be appreciated that the depicted example is merely intended to be illustrative and not limiting. In particular, in other embodiments, a fluid valve 28 in a well system 10 may have a different valve body 72. For example, in other embodiments, the valve body 72 of a fluid valve 28 may be a single integrated component and, thus, not include a central spool 76 and separate side caps 78.

In any case, as depicted, the fluid-powered valve actuator 68A is secured to the valve body 72. In particular, although obfuscated from view, the fluid-powered valve actuator 68A extends into the valve body 72 such that the fluid-powered actuator is coupled to a flow control component, such as a gate or a ball, disposed within the fluid bore 74 of the fluid valve 28A. Accordingly, actuating the fluid-powered valve actuator 68A may move the flow control component within the fluid bore 74 to transition the fluid valve 28A between an open state and a closed state in an automated manner.

Nevertheless, as in the depicted example, to enable manual control by an operator, in some embodiments, a fluid valve 28 in a well system 10 may include a manual valve actuator 70, such as a handle or a wheel. In particular, although somewhat obfuscated from view in the depicted example, the manual valve actuator 70 extends through the fluid-powered valve actuator 68A and the valve body 72 such that the manual valve actuator 70 is also coupled to the flow control component of the fluid valve 28A. Accordingly, actuating the manual valve actuator 70 may also move the flow control component within the fluid bore 74 to transition the fluid valve 28A between its open state and its closed state, for example, to enable an operator to manually override automated operation via the fluid-power valve actuator 68A.

However, it should again be appreciated that the depicted example is merely intended to be illustrative and not limiting. In particular, in other embodiments, a fluid valve 28 in a well system 10 may not include a manual valve actuator 70. In fact, in some embodiments, a subset of fluid valves 28 (e.g., upper master valve 30A) may include a manual valve actuator 70 while a different subset of fluid valves 28 (e.g., lower master valve 30B, wing valve 34, and/or swab valve 32) do not include a manual valve actuator 70.

In any case, as in the depicted example, to facilitate controlling actuation direction thereof and, thus, the transitioning of a corresponding fluid valve 28 between its open state and its closed state, in some embodiments, a fluid-powered valve actuator 68A may include multiple fluid ports 71—namely an open fluid port 71A and a close fluid port 71B. In particular, when actuation (e.g., pressurized) fluid is supplied to the open fluid port 71A in the depicted example, the fluid-powered valve actuator 68A may actuate the flow control component in a first direction such that the fluid valve 28A transitions from its closed state toward its open state. On the other hand, when actuation fluid is supplied to the close fluid port 71B in the depicted example, the fluid-powered valve actuator 68B may actuate the flow control component in a second (e.g., opposite) direction such that the fluid valve transition from its open state toward its closed state.

However, it should again be appreciated that the depicted example is merely intended to be illustrative and not limiting. In particular, in other embodiments, a fluid-powered valve actuator 68A of a fluid valve 28 may include a single fluid port 71. In such embodiments, the fluid valve 28 may be transitioned from its open state toward its closed state by supplying actuation fluid to the fluid port 71 on the fluid-powered valve actuator 68A and transitioned from its closed state toward its open state by extracting actuation fluid from the fluid port 71 on the fluid-powered valve actuator 68A. Additionally or alternatively, as mentioned above, in other embodiments, an automated valve actuator 68 of a fluid valve 28 may be an electromechanical valve actuator 68.

In any case, as in the example depicted in FIG. 1, to facilitate powering operation of equipment, such as a fluid valve 28 and/or a fluid pump 50, therein, a well system 10 generally includes a power sub-system 80. As depicted, a power sub-system 80 generally includes a power source 82. In particular, in some embodiments, a power source 82 in a power sub-system 80 may be a mechanical power source 82, such as an internal combustion engine. However, in other embodiments, a power source 82 in a power sub-system 80 may be an electrical power source 82, such as an electrical grid and/or an electrical generator.

In fact, in some embodiments when a power source 82 in its power sub-system 80 is an electrical power source 82, equipment in a well system 10 may nevertheless be mechanically powered. In particular, as in the depicted example, to facilitate mechanically powering equipment using an electrical power source 82, a power sub-system 80 may include a fluid power assembly 84.

To facilitate pressurizing actuation fluid and, thus, mechanically powering operation of equipment, as in the depicted example, a fluid power assembly 84 in a power sub-system 80 may generally include an actuation fluid reservoir (e.g., tank) 86 and a fluid pump 50—namely an actuation fluid pump 50B, which is fluidly coupled between the actuation fluid reservoir 86 and the equipment. Additionally, as in the depicted example, to enable selectively powering operation of different equipment, in some embodiments, a fluid power assembly 84 may include a fluid manifold 88 fluidly coupled between the actuation fluid pump 50B and the equipment as well as one or more fluid valves 28 and one or more fluid conduits 40 fluidly coupled between the fluid manifold 88 and the equipment. In particular, as in the depicted example, a set of one or more fluid valves 28 may be fluidly coupled between the fluid manifold 88 and a corresponding fluid port 90, which is fluidly coupled to a fluid port 71 on a fluid-powered valve actuator 68A of a fluid valve 28 via one or more fluid conduits 40. For example, a first fluid port 90A of the fluid power assembly 84 may be fluidly coupled to an open fluid port 71A on a fluid-powered valve actuator 68A of a fluid valve 28, such as a working (e.g., swab or master) valve in a fracturing tree 26, while a second fluid port 90B of the fluid power assembly 84 may be fluidly coupled to a close fluid port 71B on the fluid-powered valve actuator 68A of the fluid valve 28.

Accordingly, in the depicted example, the actuation fluid pump 50B and the fluid valves 28 in the fluid power assembly 84 may operate to selectively supply actuation fluid to a fluid-powered valve actuator 68A of a fluid valve 28 to mechanically power operation of the fluid valve 28. Additionally, in the depicted example, operation of the actuation fluid pump 50B and the fluid valves 28 in the fluid power assembly 84 may be electrically powered by the power source 82. Accordingly, as in the depicted example, in some embodiments, one or more electrical conduits (e.g., wires and/or cables) 92 may be coupled between a power source 82 in a power sub-system 80 and an actuation fluid pump 50B and fluid valves 28 in a fluid power assembly 84 of the power sub-system 80.

However, it should again be appreciated that the depicted example is merely intended to be illustrative and not limiting. In particular, in other embodiments, the operation (e.g., pumping rate) of other well system equipment, such as a fluid pump 50, may additionally or alternatively be controlled using pressurized actuation fluid. Nevertheless, in other embodiments, equipment, such as a fluid valve 28 and/or a fluid pump 50, in a well system 10 may be electrically powered and, thus, its power sub-system 80 may not include a fluid power assembly 84 and one or more electrical conduits 92 may be coupled between an electrical power source 82 in the power sub-system 80 and the well system equipment. Alternatively, in other embodiments, a power source 82 in a power sub-system 80 that powers well system equipment, such as a fluid valve 28 and/or a fluid pump 50, may be a mechanical power source 82 and, thus, mechanically coupled to the well system equipment, for example, via shafts and/or gears.

In any case, as in the depicted example, to facilitate controlling operation of well system equipment, in some embodiments, a power sub-system 80 may additionally include a power converter 94 coupled between the power source 82 and the well system equipment. For example, when the power source 82 is an electrical power source, the power converter 94 may be an electrical power converter 94, which operates to adjust voltage, current, magnitude, amplitude, phase, frequency, polarity, and/or the like of electrical power received from the electrical power source 82 before supply to the well system equipment. Alternatively, when the power source 82 is a mechanical power source, the power converter 94 may be a mechanical power converter 94, such as a transmission or gearbox, which operates to adjust velocity, torque, direction, and/or the like of mechanical power received from the mechanical power source 82 before supply to the well system equipment.

However, it should again be appreciated that the depicted example is merely intended to be illustrative and not limiting. In particular, in other embodiments, a power sub-system 80 in a well system 10 may not include a power converter 94, for example, when operation of its power source 82 is directly controlled to control its output power and, thus, the power supplied to well system equipment.

In any case, as in the depicted example, to facilitate selectively powering operation of different well system equipment using the same power source 82, in some embodiments, a power sub-system 80 may additionally include a switching assembly 96 coupled between the power source 82 and the well system equipment. For example, when the power source 82 is an electrical power source 82, the switching assembly 96 may be a switchgear assembly, which operates to selectively connect input electrical power to a subset of electrical conduits 92 that each connects to different well system equipment. Alternatively, when the power source 82 is a mechanical power source, the switching assembly 96 may be a gear change assembly, which operates to selectively connect an input gear driven by input mechanical power to a subset of output gears that are each mechanically coupled to different well system equipment.

However, it should again be appreciated that the depicted example is merely intended to be illustrative and not limiting. In particular, in other embodiments, a switching assembly 96 in a power sub-system 80 may be coupled between a power source 82 and a power converter 94. Alternatively, in other embodiments, a power sub-system 80 in a well system 10 may not include a switching assembly 96, for example, when the power sub-system 80 has a power source 82 dedicated to each piece of well system equipment.

In any case, as in the depicted example, to facilitate controlling and, thus, at least partially automating operation of equipment therein, a well system 10 generally includes a control sub-system 98. To facilitate communication therewith, as depicted, a control sub-system 98 in a well system 10 generally includes more input/output (I/O) devices 104.

In particular, in some embodiments, I/O devices 104 of a control sub-system 98 may include one or more input/output (I/O) ports (e.g., terminals), which enable the control sub-system 98 to be communicatively coupled to well system equipment, for example, in addition to one or more sensors 106 via a wired or wireless communication network. Accordingly, as in the depicted example, the I/O devices 104 of a control sub-system 98 may enable the control sub-system 98 to communicate (e.g., output) control signals 108 that instruct well system equipment to perform corresponding control actions. For example, the control sub-system 98 may communicate a control signal 108 that instructs an automated valve actuator 68 to transition a fluid valve 28 from its current open state to a target closed state or vice versa. As another example, the control sub-system 98 may communicate a control signal 108 that instructs a pump actuator (e.g., motor) to transition a fluid pump 50 from a current lower pumping rate (e.g., off) state to a target higher pumping rate (e.g., on) state or vice versa.

Furthermore, as in the depicted example, in some embodiments, the I/O devices 104 of a control sub-system 98 in a well system 10 may enable the control sub-system 98 to receive sensor signals 110, which are indicative of a current state of the well system 10. In particular, in some such embodiments, a control sub-system 98 may be communicatively coupled to one or more equipment sensors 106A, which operate to return sensor signals 110 indicative of an equipment state of corresponding well system equipment. For example, an equipment sensor 106A associated with a fluid valve 28 may return sensor signals 110 indicative of a current valve state of the fluid valve 28 (e.g., whether fully open state, fully closed state, or intermediate state between fully open state and fully closed state). As another example, an equipment sensor 106A associated with a fluid pump 50 may return sensor signals 110 indicative of a current pumping rate state of the fluid pump 50.

Additionally or alternatively, in some such embodiments, a control sub-system 98 in a well system 10 may be communicatively coupled to one or more fluid parameter sensors 106B, which operate to return sensor signals 110 indicates of fluid parameters, such as fluid pressure, fluid composition, fluid temperature, and/or the like, within the well system 10. For example, a first (e.g., upstream) fluid parameter sensor 106B coupled immediately upstream from a fluid valve 28 such that no other fluid valves 28 are disposed therebetween may return sensor signals 110 indicative of fluid parameters flowing into the fluid valve 28 while a second (e.g., downstream) fluid parameter sensor 106B coupled immediately downstream from the fluid valve 28 such that that no fluid valves 28 are disposed therebetween may return sensor signals 110 indicative of fluid parameters flowing out from the fluid valve 28. As another example, a fluid parameter sensor 106B coupled at an outlet of a fluid pump 50 may return sensor signals 110 indicative of fluid parameters being flowed out of the fluid pump 50.

Furthermore, in some such embodiments, a control sub-system 98 in a well system 10 may be communicatively coupled to one or more optical sensors 106C, such as a camera, which operate to return sensor signals 110 indicative of a visual representation (e.g., image or video) of a targeted area in the well system 10. For example, an optical sensor 106C focused on (e.g., targeted at) a fluid valve 28 may return sensor signals 110 indicative of a visual representation of the fluid valve 28 to enable an operator to confirm a current valve state of the fluid valve 28 and, thus, whether the fluid valve 28 has achieved its target valve state.

In fact, as in the depicted example, to facilitate improving visual recognition of its current valve state, in some embodiments, a fluid valve 28 may additionally include a visual indicator 112, such as a flag or arm. In particular, as in the depicted example, a visual indicator 112 may be secured to a (e.g., automated or manual) valve actuator of a fluid valve 28, for example, such that the visual indicator 112 extends radially outward. Accordingly, when the valve actuator actuates (e.g., rotates) to move a corresponding flow control component of the fluid valve 28, the visual indicator 112 may move in a corresponding manner to provide an exaggerated visual indication of the current position of the flow control component and, thus, the current valve state of the fluid valve 28. For example, to provide an exaggerated visual indication of the valve state of a corresponding fluid valve 28, a visual indicator 112 may be in a first (e.g., vertical) orientation while the fluid valve 28 is in its fully open state, a second (e.g., horizontal) orientation while the fluid valve 28 is in its fully closed state, and a third (e.g., slanted) orientation between the first orientation and the second orientation while the fluid valve 28 is in an intermediate valve state.

However, it should again be appreciated that the depicted example is merely intended to be illustrative and not limiting. In particular, in other embodiments, a fluid valve 28 may not include a visual indicator 112 or utilize a different type of visual indicator, such as a light-emitting diode that emits light while the fluid valve 28 is in a first (e.g., closed) valve state and does not emit light while the fluid valve is in a second (e.g., open and/or different) valve state. Additionally, in some embodiments, a fracturing tree 26 may include a data acquisition module that gathers sensor signals 110 associated with fluid valves 28 on the fracturing tree, for example, before relaying the sensor signals 110 to a central controller.

In any case, as in the depicted example, to facilitate analyzing sensor signals 110 and/or generating control signals 108 and, thus, controlling operation of a well system 10, a control sub-system 98 therein generally includes one or more processors 114 and memory 116. In particular, memory 116 in a control sub-system 98 may generally include one or more tangible, non-transitory, computer-readable media that are implemented and/or operated to store data and/or executable instructions. For example, as will be described in more detail below, the memory 116 may store an operation schedule and/or an operation log for a corresponding well system 10. As another example, the memory 116 may store sensor data, such as equipment state, fluid parameters, and/or image data, based on one or more sensor signals 110. Accordingly, in some embodiments, the memory 116 may include volatile memory, such as random-access memory (RAM), and/or non-volatile memory, such as read-only memory (ROM), flash memory, a solid-state drive (SSD), a hard disk drive (HDD), or any combination thereof.

Additionally, a processor 114 in a control sub-system 98 may generally include processing circuitry that is implemented and/or operated to process data and/or execute instructions stored in memory 116. For example, the processor 114 may process equipment operational parameters associated with well system equipment to determine a current equipment state of the well system equipment and, as will be described in more detail below, may process fluid parameters stored in memory 116 to secondarily confirm the current equipment state of the well system equipment. As another example, to automate operation of well system equipment, the processor 114 may process a current equipment state of the well system equipment relative to an operation schedule stored in memory 116 to generate control signals 108 that instruct performance of control actions that adjust the well system equipment to a target (e.g., different) equipment state. Accordingly, in some embodiments, a processor 114 in a control sub-system 98 may include one or more general purpose microprocessors, one or more application specific integrated circuits (ASICs), one or more field programmable gate arrays (FPGAs), or any combination thereof.

In any case, in addition to I/O ports, to enable communication with an operator (e.g., user), I/O devices 104 of a control sub-system 98 may include one or more user output devices and one or more user input devices. In particular, in some embodiments, a user output device of a control sub-system 98 may include an electronic display, for example, which is implemented and/or operated to display a graphical user interface (GUI) that provides a visual representation of an equipment state, a visual representation of a fluid parameter, a prompt for response, and/or an image of well system equipment. Additionally, in some embodiments, a user input device of a control sub-system 98 may include a hard button, a soft button (e.g., touch sensor), a microphone, a keyboard, a camera, and/or a mouse, for example, which enable an operator to respond to a prompt and/or to request a change to an equipment state.

However, it should again be appreciated that the depicted example is merely intended to be illustrative and not limiting. In particular, as mentioned above, to produce fluid from a well 14 in a well system 10, multiple different parties and, thus, corresponding operator groups may need to perform operations in the well system 10. Additionally, as mentioned above, at least in some instances, improper coordination between different operations in a well system 10 may potentially limit operational efficiency (e.g., production time) of the well system 10, for example, due to corrective actions needing to be performed before normal operation can resume. Accordingly, although depicted as a single block in FIG. 1, the control sub-system 98 of a well system 10 may in fact be distributed between multiple operators and, thus, multiple operator devices.

Figure 3:
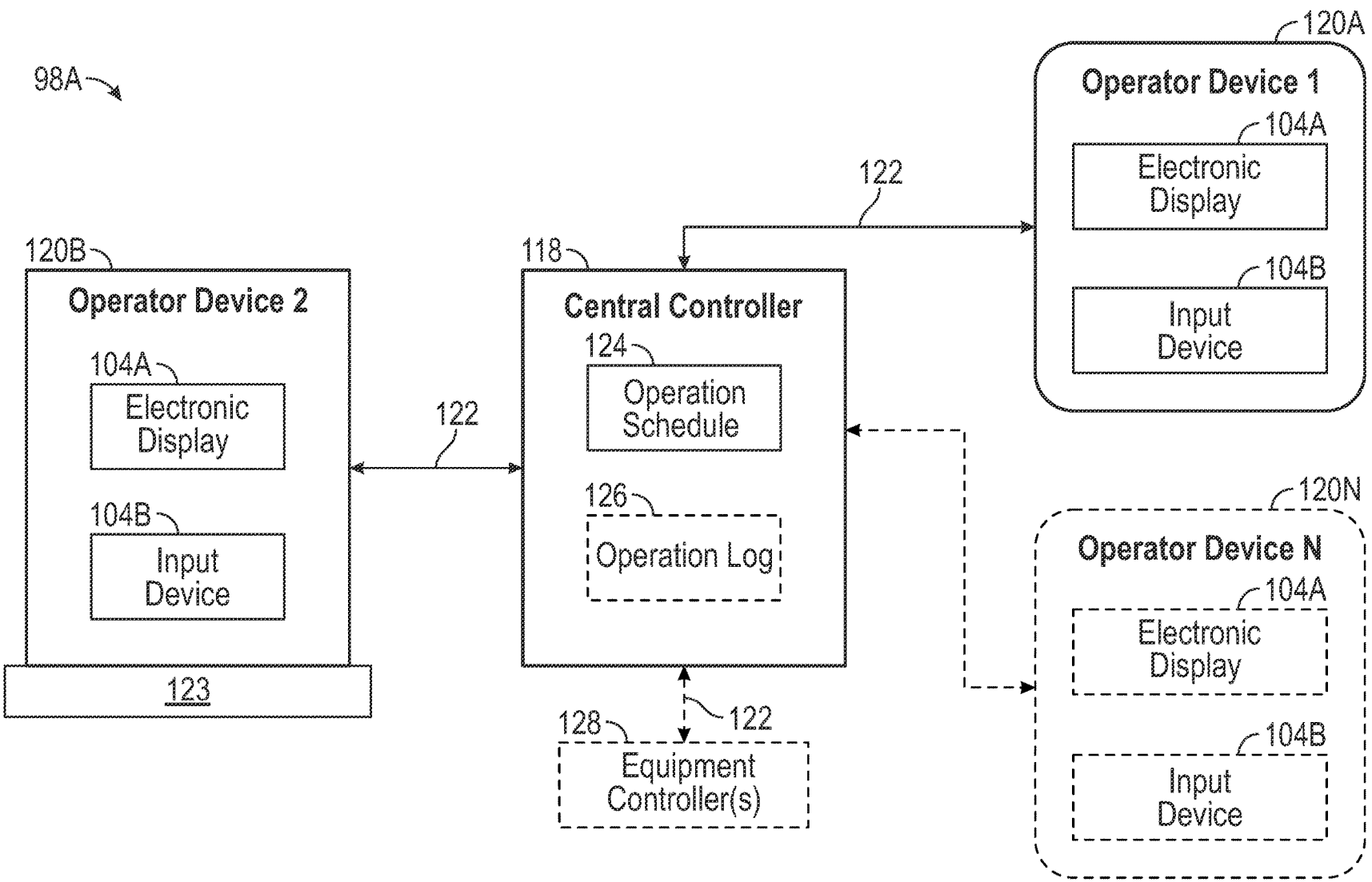
FIG. 3 is a block diagram of an example of a distributed control sub-system that may be included in the well system of FIG. 1, in accordance with an embodiment of the present disclosure.

To help illustrate, an example of a distributed control sub-system 98A that may be included in a well system 10 is shown in FIG. 3. As depicted, the distributed control sub-system 98A generally includes multiple operator devices 120. In particular, in the depicted example, a first operator device 120A and an Nth operator device 120N are each a mobile device, such as a mobile phone, a tablet computer, a laptop computer, or the like. On the other hand, in the depicted example, a second operator device 120B is a human-machine interface (HMI) mounted on a skid 123.

Additionally, to facilitate properly and efficiently coordinating operations of multiple different parties and, thus, corresponding operator groups, in some embodiments, an operator device 120 may be assigned to and associated with a representative operator of an operator group. For example, in the depicted example, the first operator device 120A may be assigned to and associated with a representative tool operator, the second operator device 120B may be assigned to and associated with a representative fracturing operator, and the Nth operator device 120N may be assigned to and associated with a representative well owner's operator.

Accordingly, as in the depicted example, to facilitate properly and efficiently coordinating requests received from and/or performance of operations associated with different operators, a distributed control sub-system 98A generally includes a central controller 118, which is communicatively coupled to each of the operator devices 120 via a (e.g., wired or wireless) communication network 122. In particular, a central controller 118 in a distributed control sub-system 98A may generally coordinate operations in a well system 10 in accordance with an operation schedule 124, for example, which is stored in memory 116 and indicates a target order and/or target duration of operations to be performed in the well system 10.

However, it should be appreciated that the depicted example is merely intended to be illustrative and not limiting. In particular, in other embodiments, an (e.g., second) operator device 120 assigned to and associated with a fracturing operator may be a mobile device. Additionally or alternatively, in other embodiments, an (e.g., first or Nth) operator device 120 assigned to and associated with a tool operator or a well owner's operator may be a human-machine interface (HMI) mounted on a skid 123. Furthermore, in other embodiments, a control sub-system 98A may only include two operator devices 120, for example, when only two operator groups. Alternatively, in other embodiments, a control sub-system 98A may include more than three (e.g., four, five, or more) operator devices 120, for example, when more than three operator groups (e.g., drilling operator and/or installation operator in addition to well owner's operator, tool operator, and fracturing operator) are expected to operate in a well system 10.

In any case, as in the depicted example, to facilitate communication with an operator, the I/O devices 104 of each operator device 120 generally include a user output device 104—namely an electronic display 104A—and a user input device 104B, such as a hard button, a soft button (e.g., touch sensor), a microphone, a camera, a keyboard, and/or a mouse. In particular, an electronic display 104A of an operator device 120 may generally display a graphical user interface (GUI) that provides an operator with a visual representation of information relevant to a corresponding well system 10. For example, an electronic display 104A of an operator device 120 may indicate a (e.g., current or target) equipment state and/or a (e.g., current or target) fluid parameter. As another example, in some embodiments, an electronic display 104A of an operator device 120 may display a prompt that requests a corresponding operator to approve performance of a next operation associated with a different operator group.

However, at least in some instances, different operator groups that operate on the same well 14 may not have a contractual relationship with one another and, thus, may be independent third parties. For example, a tool operator and a fracturing operator may each have a contractual relationship with a well owner, but not with one another. In other words, at least in some instances, a first (e.g., tool) operator may not have the authority to control or approve operations associated with a second (e.g., fracturing and/or different) operator. Accordingly, in other embodiments, an electronic display 104A of an operator device 120 may display a prompt that requests a corresponding operator to confirm completion of their preceding operation. As another example, in some embodiments, an electronic display 104A of an operator device 120 may display a prompt that requests that a corresponding operator to finalize or re-confirm their request to perform an operation, for example, after a different operator has confirmed completion of their preceding operation.

In any case, a user input device 104B of an operator device 120 may generally enable an operator to interact with a corresponding well system 10. For example, in some embodiments, a user input device 104B of an operator device 120 may enable an operator to request that well system equipment change from a current equipment state to a target (e.g., different) equipment state to perform a control action step in an operation. However, as will be described in more detail below, to facilitate reducing the likelihood of operator (e.g., human and/or user) error since an operation may include multiple control action steps that need to be sequentially performed, in other embodiments, a central controller 118 may merely enable an operator to request that a well system 10 perform the operation as a whole and the well system 10 may automatically execute control action steps in the operation when appropriate, for example, instead of enabling the operator to individually control well system equipment from their operator device 120.

As another example, to facilitate appropriately coordinating operations of different operators, in some embodiments, a user input device 104B of an operator device 120 may enable a first operator to approve performance of a next operation associated with a second operator, for example, in response to a prompt on the electronic display 104A of their operator device 120. In such embodiments, a central controller 118 may lockout performance of the second operator's next operation via their operator device 120 until approval is received from the first operator.

However, as described above, at least in some instances, different operators that operate on the same well 14 may be independent third parties and, thus, an operator may not have the authority to control or approve operations of associated with a different operator group. Accordingly, to facilitate appropriately coordinating operations of different operators, in other embodiments, a user input device 104B of an operator device 120 may enable a first operator to confirm completion of their preceding operation, for example, in response to a prompt on the electronic display 104A of the operator device 120. In particular, in such embodiments, a central controller 118 may lockout performance of a second operator's next operation via their operator device 120 until completion confirmation of their preceding operation is received from the first operator, for example, and the second operator, subsequently, finalizes or re-confirms their request to perform their next operation via their operator device 120.

To facilitate traceability, in some embodiments, a central controller 118 may keep an operation log 126, for example, in memory 116. In particular, in some such embodiments, an operation log 126 may track when an operator approved performance of a next operation of another operator and when the other operator actually performed their next operation, for example, in addition to when the other operator requested performance of their next operation. However, in other such embodiments, an operation log 126 may track when an operator confirmed completion of their preceding operation and when another operator performed their next operation, for example, in addition to when the other operator requested performance of their next operation and/or when the other operator subsequently finalized or re-confirmed their request to perform their next operation.

Accordingly, in such embodiments, if an issue that requires corrective action occurs in a well system 10, a corresponding operation log 126 may be referenced to identify a potential coordination breakdown that caused the issue, for example, to help avoid the issue in the future and/or to assign responsibility. In fact, to facilitate avoiding an issue that occurred during a previous cycle of an operation schedule 124, in some embodiments, a central controller 118 may adaptively adjust the operation schedule 124 before using the operation schedule 124 during a subsequent cycle. For example, when a pervious cycle of the operation schedule 124 resulted in a first operation, which was performed before or concurrently with a second operation, inadvertently disrupting performance of the second operation, the central controller 118 may adaptively adjust the operation schedule 124 to require that the first operation be performed after completion of the second operation during a subsequent cycle of the operation schedule 124.

In any case, once a lockout is removed from an operator of a well system 10, a central controller 118 may permit performance of the operator's next operation in the well system 10 from their operator device 120. In particular, in some embodiments, the central controller 118 may remove a lockout from an operator to enable the operator to perform their next operation by controlling the operation of individual well system equipment from their operator device 120. For example, when performance of a hydraulic fracturing operation is permitted, the central controller 118 may remove a lockout from an operator (e.g., fracturing operator or well owner's operator) to permit the operator to instruct, via their operator device 120, a swab valve 32 on a fracturing tree 26 to transition to its closed state, after the swab valve 32 has achieved its closed state, instruct a corresponding isolating valve (e.g., branch isolating valve 64 on a corresponding header branch 62 and/or fluid valve 28 fluidly coupled between a fracturing fluid source 46 and the fracturing tree 26) to transition to its open state, and, after the isolating valve have achieved its open state, instruct a working (e.g., master valve 30) on the fracturing tree 26 to transition to its open state.

However, to facilitate reducing the likelihood of operator error and, thus, improving well system operational efficiency since an operation may include multiple control action steps that need to be sequentially performed, in other embodiments, a central controller 118 may keep an operator locked out from controlling operation of individual well system equipment even after performance of the operator's next operation is permitted. Instead, in some such embodiments, a central controller 118 may merely enable an operator to instruct performance of their next permitted operation as a whole and the central controller 118 may automatically control operation of well system equipment to perform the operation, for example, when permitted after completion confirmation for a preceding operation has been received and after the operator, subsequently, finalizes or re-confirms their request. For example, the central controller 118 may merely enable an operator (e.g., fracturing operator or well owner's operator) to instruct performance of a hydraulic fracturing operation as a whole from their operator device 120 and, when performance is permitted, automatically instruct a swab valve 32 on a fracturing tree 26 to transition to its closed state, after the swab valve 32 has achieved its closed state, automatically instruct a corresponding isolating valve (e.g., branch isolating valve 64 on corresponding header branch 62 and/or fluid valve 28 fluidly coupled between a fracturing fluid source 46 and the fracturing tree 26) to transition to its open state, and, after the isolating valve has achieved its open state, automatically instruct a working valve (e.g., master valve 30) on the fracturing tree 26 to transition to its open state.

In fact, to facilitate improving changeover between different operations and, thus, further improving well system operational efficiency, in some embodiments, a central controller 118 may automatically initiate performance of an operation when appropriate, for example, instead of waiting for a corresponding operator to explicitly request or instruct performance. In particular, in some such embodiments, a central controller 118 may automatically begin determining when performance of an operator's next operation is appropriate upon receiving the operator's completion confirmation for their preceding operation. For example, upon receiving confirmation from a fracturing operator that a fluid preparation (e.g., blending and/or mixing) operation is complete, the central controller 118 may automatically begin determining whether performance of a hydraulic fracturing operation is appropriate.

In any case, as in the depicted example, in some embodiments, well system equipment may include its own equipment controller 128. Accordingly, to perform an operation in such embodiments, a central controller 118 may relay instructions to an equipment controller 128 and the equipment controller 128 may then control the operation of corresponding well system equipment accordingly.

However, it should again be appreciated that the depicted example is merely intended to be illustrative and not limiting. In particular, in other embodiments, well system equipment may not have its own equipment controller 128 and, thus, a central controller 118 may directly control operation of the well system equipment. In any case, in this manner, a distributed control sub-system 98A in a well system 10 may facilitate properly and efficiently coordinating operations of different operators in the well system 10, which, at least in some instances, may facilitate improving operational efficiency (e.g., production time) of the well system 10, for example, by enabling different operators to work at least partially in parallel while reducing the issues that occur and, thus, corrective actions needed due to improper coordination between the different operators.

Figure 4:
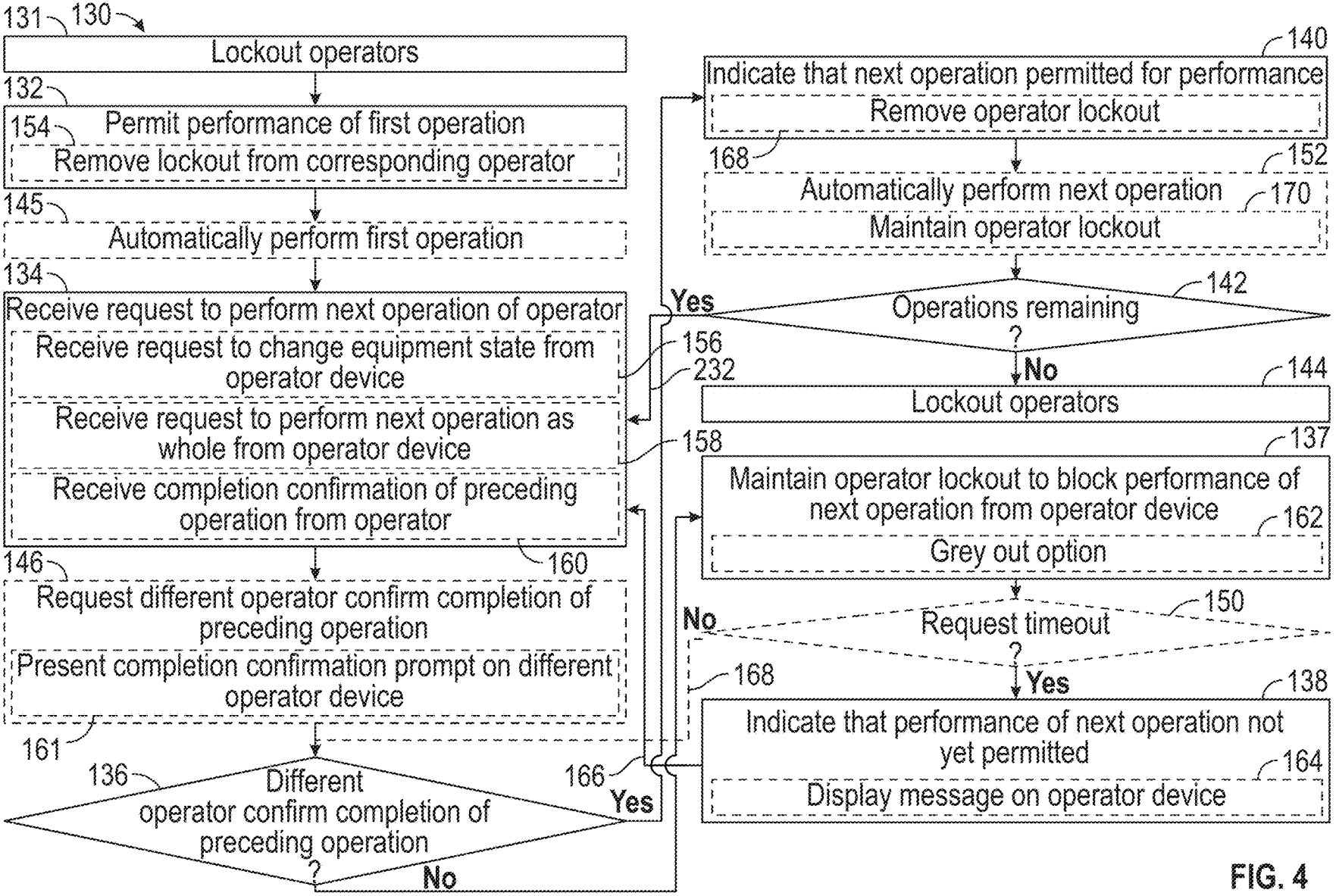
FIG. 4 is a flow diagram describing an example of a process for coordinating operations performed by different operator groups around a well system, in accordance with an embodiment of the present disclosure.

To help further illustrate, an example of a process 130 for coordinating performance of operations in a well system 10 is described in FIG. 4. Generally, the process 130 includes locking out operators (process block 131), permitting performance of a first operation (process block 132), receiving a request to perform a next operation of an operator (process block 134), and determining whether a different operator has confirmed completion of a preceding operation (decision block 136). Additionally, when the different operator has not confirmed completion of the preceding operation, the process 130 generally includes maintaining the operator locked out to block performance of the next operation from an operator device (process block 137) and indicating that performance of the next operation is not yet permitted (process block 138). On the other hand, when the different operator has confirmed completion of the preceding operation, the process 130 generally includes indicating that the next operation is permitted for performance (process block 140), determining whether any operations remain (decision block 142), and locking out the operators when no operations remain (process block 144).

However, it should be appreciated that the example process 130 is merely intended to be illustrative and not limiting. In particular, in other embodiments, a process 130 for coordinating operations in a well system 10 may omit one of the or more depicted process blocks or decision blocks. Additionally or alternatively, in some embodiments, a process 130 for coordinating performance of operations in a well system 10 may include one or more additional process blocks and/or one or more additional decision blocks. For example, in some embodiments, the process 130 may additionally include automatically performing the first operation (process block 145) and/or requesting that the different operator confirm completion of the preceding operation (process block 146). As another example, when the different operator has not confirmed completion of the preceding operation, in some embodiments, the process 130 may additionally include determining whether a request timeout has been reached (decision block 150). As a further example, when the different operator has confirmed completion of the preceding operation, in some embodiments, the process 130 may additionally include automatically performing the next operation (process block 152).

Additionally, in some embodiments, a process 130 for coordinating performance of operations in a well system 10 may be performed at least in part by executing instructions stored in one or more tangible, non-transitory, computer-readable media, such as control sub-system memory 116, using processing circuitry, such as one or more control sub-system processors 114. In other words, in some embodiments, the process 130 may be performed at least in part by a control sub-system 98, such as a distributed control sub-system 98A (e.g., central controller 118 and multiple operator devices 120), of a well system 10.

Accordingly, to coordinate performance of operations by different operators in a well system 10, a control sub-system 98 may initially place a lockout on all operators (process block 131). In particular, the control sub-system 98 may place a lockout on an operator to block the operator from controlling operation of equipment, such as a fluid valve 28 or a fluid pump 50, in the well system 10 from their operator device 120.

The control sub-system 98 may then permit performance of a first operation in the well system 10, for example, in accordance with an operation schedule 124 (process block 132). In particular, in some embodiments, the control sub-system 98 may remove a lockout from a corresponding operator to enable the operator to perform the first operation by controlling operation of individual well system equipment from their operator device 120 (process block 154). For example, to perform a perforation operation on a well 14, the control sub-system 98 may remove a lockout from a tool operator to enable the tool operator to instruct, via their operator device 120, that each working (e.g., swab or master) valve on a corresponding fracturing tree 26 transition to its open state. As another example, to perform a shut-in operation on a well 14 (e.g., between a perforation operation and a hydraulic fracturing operation), the control sub-system 98 may remove a lockout from a well owner's operator to enable the well owner's operator to instruct, via their operator device 120, that each working (e.g., swab or master) valve on the fracturing tree 26 transition to its closed state.

However, to facilitate reducing operator error and, thus, improving well system operational efficiency, in other embodiments, the control sub-system 98 may automatically perform the first operation in the manner described in more detail below without removing the lockout from the corresponding operator (process block 145). In other words, in such embodiments, the control sub-system 98 may keep an operator locked out even while a corresponding operation is permitted for performance in the well system 10.

Moreover, although some operations may need to be sequentially performed on a well 14, in some embodiments, to facilitate improving well system operational efficiency, multiple different operators may nevertheless work at least partially in parallel. In other words, in such embodiments, multiple different operators may concurrently perform their first operations. For example, although a hydraulic fracturing operation is generally performed on a well 14 after a perforation operation, a fracturing operator may perform a fluid preparation operation while a tool operator is performing the perforation operation.

In any case, the control sub-system 98 may then receive a request to perform a next operation of an operator (process block 134). In particular, in some embodiments, an operator may explicitly request an adjustment to an equipment state of individual well system equipment from their operator device 120. For example, to perform a hydraulic fracturing operation on a well 14, an operator (e.g., a fracturing operator or a well owner's operator) may explicitly request that a swab valve 32 on a corresponding fracturing tree 26 transition to its closed state and/or that a master valve 30 on the fracturing tree 26 transition to its open state via their operator device 120. Accordingly, in such embodiments, a central controller 118 of the control sub-system 98 may receive an explicit request from an operator to change an equipment state of individual well system equipment, such as fluid valve 28 or a fluid pump 50, from a corresponding operator device 120, for example, via a communication network 122 (process block 156).

However, as described above, to perform an operation, at least in some instances, multiple different pieces of well system equipment may need to be controlled. In fact, at least in some such instances, different pieces of well system equipment may need to be controlled to perform sequential control action steps in an operation. For example, to perform a hydraulic fracturing operation on a well 14, a swab valve 32 on a corresponding fracturing tree 26 may need to be transitioned to its closed state in a first control step before a corresponding isolating valve (e.g., branch isolating valve 64 on corresponding header branch 62 and/or fluid valve 28 fluidly coupled between a fracturing fluid source 46 and the fracturing tree 26) is transitioned to its open state in a second (e.g., subsequent) control action step, a working valve (e.g., master valve 30) on the fracturing tree 26 is transitioned to its open state in a third (e.g., further subsequent) control action step, and a corresponding fracturing fluid pump 50A is transitioned from its off (e.g., non-pumping) state to an on (e.g., pumping) state in a fourth (e.g., still further subsequent) control action step. Accordingly, in some embodiments, to perform the hydraulic fracturing operation on the well 14, an operator (e.g., a fracturing operator or a well owner's operator) may explicitly request via their operator device 120 that the swab valve 32 be transitioned to its closed state to perform the first control action step before explicitly requesting that the isolating valve be transitioned to its open state to perform the second control step, explicitly requesting that the working valve be transitioned to its open state to perform the third control action step, and explicitly requesting that the fracturing fluid pump 50A transition to an on state to perform the fourth control action step.

However, despite being performed by the same operator, in some instances, improper coordination between control action steps in an operation may nevertheless occur and potentially cause issues in a well system 10 that require corrective action before normal operation can resume, thereby potentially limiting operational efficiency (e.g., production time) of the well system 10. For example, transitioning a fracturing fluid pump 50A to an on (e.g., pumping) state before a corresponding isolating valve (e.g., branch isolating valve 64 on corresponding header branch 62 and/or fluid valve 28 fluidly coupled between a fracturing fluid source 46 and the fracturing tree 26) has achieved its open state may inadvertently deadhead the fracturing fluid pump 50A, which, at least in some instances, may reduce the lifespan of the fracturing fluid pump 50A and, thus, increase the frequency of corrective actions (e.g., swapping out fracturing fluid pumps 50). As another example, transitioning the fracturing fluid pump 50A to its on state when the isolating valve has achieved its open state, but a corresponding swab valve 32 has not achieved its closed state may result in fracturing fluid inadvertently leaking to the surrounding environment and, thus, potentially necessitate corrective actions (e.g., environmental cleanup) before normal operation can resume.

Accordingly, to facilitate reducing operator error and, thus, improving well system operational efficiency, in other embodiments, a control sub-system 98 may instead merely permit an operator to request performance of an operation as a whole from their operator device 120 and, thus, receive a request to perform the operator's next operation as a whole from their operator device 120 (process block 158). For example, the control sub-system 98 may permit an operator (e.g., a fracturing operator or a well owner's operator) to request performance of a hydraulic fracturing operation as a whole from their operator device 120, but not permit the operator to request that an individual fluid valve 28 or an individual fluid pump 50 change to a different equipment state. As will be described in more detail below, in such embodiments, once an operation is permitted for performance, the control sub-system 98 may automatically perform the operation while keeping a corresponding operator locked out, which, at least in some instances, may facilitate reducing the likelihood of operator error resulting in improper coordination between control action steps in the operation and, thus, improving well system operational efficiency.

In fact, to facilitate expediting change over between different operations and, thus, further improving well system operational efficiency, in some embodiments, the control sub-system 98 may preemptively (e.g., automatically) request performance of an operator's next operation when the operator confirms completion of their preceding operation, for example, instead of waiting for the operator to explicitly request performance of their next operation (process block 160). As an illustrative, non-limiting example, the control sub-system 98 may preemptively request performance of a hydraulic fracturing operation once a fracturing operator confirms completion of a fluid preparation operation.

In any case, before permitting performance of an operator's next operation, the control sub-system 98 may determine whether a different operator has confirmed completion of their preceding operation, for example, in accordance with an operation schedule 124 (decision block 136). In particular, to facilitate proper coordination, the control sub-system 98 may determine whether completion confirmation has been received from each operator that performs a preceding operation that may be inadvertently affected by performance of the operator's next operation and, thus, potentially multiple different operators. For example, before permitting performance of a hydraulic fracturing operation, the control sub-system 98 may determine whether a tool operator has confirmed completion of a perforation operation.

To facilitate expediting completion confirmation and, thus, change over from the different operator's preceding operation to the operator's next operation, in some embodiments, the control sub-system 98 may explicitly request that the different operator confirm completion of their preceding operation, for example, in response to a request to perform the operator's next operation (process block 146). In particular, in some such embodiments, the control sub-system 98 may display a prompt on an electronic display 104A of the different operator's operator device 120 that requests that the different operator confirm completion of their preceding operation (process block 161). For example, the control sub-system 98 may display a prompt on the operator device 120 of a tool operator that requests that the tool operator confirm completion of a perforation operation.

In any case, when the different operator has not yet confirmed completion of their preceding operation, the control sub-system 98 may maintain the lockout of the operator to block the operator from performing their next operation from their operator device 120 (process block 137). In other words, the control sub-system 98 may maintain the lockout on the operator to block the operator from controlling well system equipment from their operator device 120, for example, by greying out an option on their operator device 120 to instruct the well system equipment to perform a control action (process block 162).

Additionally, when the different operator has not yet confirmed completion of their preceding operation, the control sub-system 98 may indicate that performance of the operator's next operation is not yet permitted (process block 138). In particular, in some embodiments, the control sub-system 98 may notify the operator that performance of their next operation is not yet permitted by displaying a message on their operator device 120 (process block 164) so that the operator can re-request performance of their next operation at a later time (arrow 166).

However, to facilitate reducing the number of times performance of a next operation needs to be re-requested, in some embodiments, the control sub-system 98 may utilize a request timeout (e.g., time threshold). In other words, in such embodiments, instead of immediately indicating that the operator's next operation is not yet permitted, the control sub-system 98 may determine whether a request timeout has been reached (e.g., elapsed) (decision block 150), continue checking for the different operator's completion confirmation until the request timeout is reached (arrow 166), and only indicate that the operator's next operation is not yet permitted once the request timeout has been reached, but the different operator has not yet confirmed completion of their preceding operation.

In any case, when the different operator has confirmed completion of their preceding operation, the control sub-system 98 may indicate that performance of the operator's next operation is now permitted, for example, by displaying a message on the operator's operator device 120 and/or in addition to placing a lockout back on the different operator (process block 140). In particular, in some embodiments, the control sub-system 98 may remove a lockout from the operator to enable the operator to perform their next operation by controlling individual well system equipment from their operator device 120, for example, by enabling selection of (e.g., un-greying) an option that instructs the well system equipment to perform a control action (process block 168). Nevertheless, before removing a lockout on an operator to enable the operator to perform an operation, in some such embodiments, the control sub-system 98 may request or enable the operator to finalize or re-confirm their request to perform the operation (e.g., by displaying a prompt on the operator's operator device 120) and cancel the request if the operator does not finalize or reconfirm their request. In other words, in such embodiments, after another operator confirms completion of their preceding operation in response to a request to perform an operation associated with an operator, the control sub-system 98 may provide the operator an opportunity to cancel their request, for example, in view of well condition changes between when the operator initiated their request and when the other operator confirmed completion of their preceding operation.

In any case, to facilitate improving well system operational efficiency, in other embodiments, the control sub-system 98 may automatically perform the operator's next operation once the different operator has confirmed completion of their preceding operation, for example, and the operator has finalized or re-confirmed their request to perform their next operation (e.g., to enable to operator to cancel their request) (process block 152). In particular, in some such embodiments, while their next operation is permitted for performance, the control sub-system 98 may nevertheless keep the operator locked out (process block 170). In other words, in such embodiments, even while their next operation is permitted for performance, the control sub-system 98 may block the operator from controlling individual well system equipment from their operator device 120, which, at least in some instances, may facilitate further reducing the likelihood of operator error and, thus, further improving well system operation efficiency.

Figure 5:
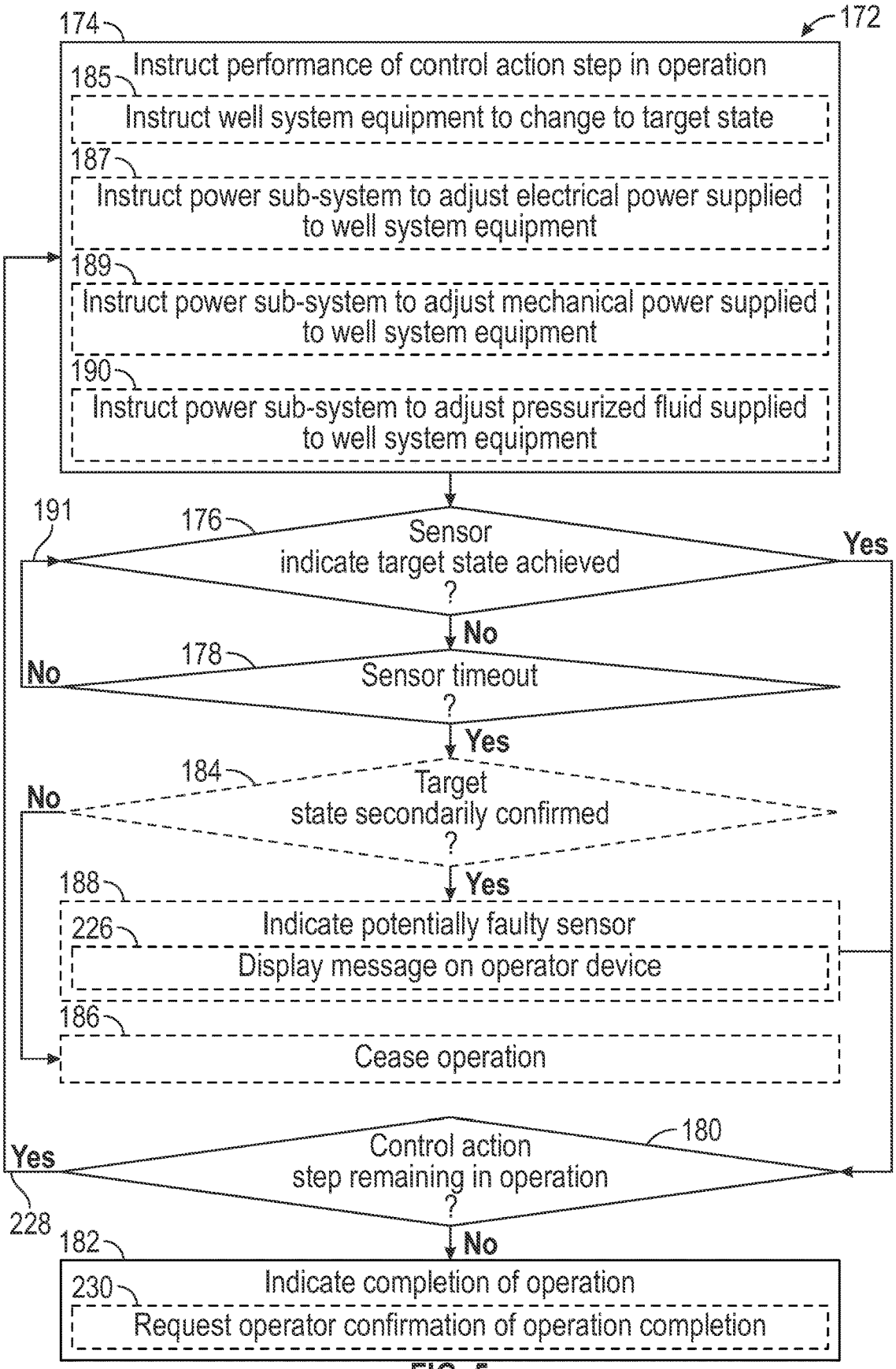
FIG. 5 is a flow diagram describing an example of a process for automating performance of an operation in a well system, in accordance with an embodiment of the present disclosure.

To help illustrate, an example of a process 172 for automatically performing an operation in a well system 10 is described in FIG. 5. Generally, the process 172 includes instructing performance of a control action step in an operation (process block 174), determining whether an equipment sensor indicates that a target equipment state has been achieved (decision block 176), and determining whether a sensor timeout has been reached (decision block 178). Additionally, the process 172 generally includes determining whether control action steps remain in the operation (decision block 180) and indicating completion of the operation when no control actions steps remain (process block 182).

However, it should be appreciated that the example process 172 is merely intended to be illustrative and not limiting. In particular, in other embodiments, a process 172 for automatically performing an operation in a well system 10 may include one or more additional process blocks and/or one or more additional decision blocks. For example, in some embodiments, a process 172 for automatically performing an operation in a well system 10 may additionally include determining whether the target equipment state is secondarily confirmed when the equipment sensor does not indicate that the target equipment state has been achieved and the sensor timeout has been reached (decision block 184), ceasing performance of the operation when the target equipment state has not been secondarily confirmed (process block 186), and indicating that the sensor is potentially faulty when the target equipment state is secondarily confirmed (process block 188).

Additionally, in some embodiments, a process 172 for automatically performing an operation in a well system 10 may be performed at least in part by executing instructions stored in one or more tangible, non-transitory, computer-readable media, such as control sub-system memory 116, using processing circuitry, such as one or more control sub-system processors 114. In other words, in some embodiments, the process 172 may be performed at least in part by a control sub-system 98, such as a distributed control sub-system 98A (e.g., central controller 118 and multiple operator devices 120), of a well system 10.

Accordingly, to automatically perform an operation in a well system 10, a control sub-system 98 may instruct performance of a control action step in the operation that changes well system equipment, such as a fluid valve 28 and/or a fluid pump 50, from a current equipment state to a target equipment state (process block 174). In particular, in some embodiments, the control sub-system 98 may simply instruct the well system equipment to execute a control action step via one or more control signals 108, for example, when the well system equipment includes its own equipment controller 128 (process block 185).

However, in other embodiments, to control well system equipment, the control sub-system 98 may control the power a power sub-system 80 of the well system 10 supplies to the well system equipment, for example, via one or more control signals 108. In particular, in some such embodiments, the control sub-system 98 may instruct the power sub-system 80 to adjust electrical power supplied from an electrical power source 82 to the well system equipment, for example, via an electrical power converter 94 and/or an electrical switching assembly 96 (e.g., switchgear) (process block 187). Merely as an illustrative, non-limiting example, the control sub-system 98 may instruct the power sub-system 80 to supply electrical power with a first (e.g., positive) polarity to a fluid valve 28 to transition the fluid valve 28 toward its closed state and electrical power with a second (e.g., negative and/or different) polarity to transition the fluid valve 28 toward its open state. As another example, the control sub-system 98 may instruct the power sub-system 80 to supply electrical power with a lower magnitude to a fluid pump 50 to transition the fluid pump 50 to a lower (e.g., slower) pumping rate state, to supply electrical power with a higher magnitude to transition the fluid pump 50 to a higher (e.g., faster) pumping rate state, and to cease supplying electrical power to the fluid pump 50 to transition the fluid pump 50 to a non-pumping (e.g., off) state.

In other such embodiments, the control sub-system 98 may control the power sub-system 80 to adjust mechanical power supplied to the well system equipment. In particular, in some such embodiments, the control sub-system 98 may instruct the power sub-system 80 to adjust mechanical power supplied from a mechanical power source 82 (e.g., internal combustion engine) to the well system equipment, for example, via a mechanical power converter 94 (e.g., transmission or gearbox) and/or a mechanical switching assembly 96 (e.g., gear change assembly) (process block 189). As an illustrative, non-limiting example, the control sub-system 98 may instruct the power sub-system 80 to actuate (e.g., rotate and/or translate) an output shaft connected to a fluid valve 28 in a first (e.g., clockwise) direction to transition the fluid valve 28 toward its closed state and to actuate the output shaft in a second (counterclockwise) direction to transition the fluid valve 28 toward its open state. As another example, the control sub-system 98 may instruct the power sub-system 80 to actuate an output shaft connected to a fluid pump 50 with a lower velocity and/or torque to transition the fluid pump 50 to a lower pumping rate state, to actuate the output shaft with a higher velocity and/or torque to transition the fluid pump 50 to a higher pumping rate state, and to cease actuating the output shaft to transition the fluid pump 50 to a non-pumping state.

However, as described above, in other such embodiments, the power sub-system 80 may include an electrical power source 82, but nevertheless adjust mechanical power supplied to well system equipment as pressurized actuation fluid to facilitate controlling operation of the well system equipment. Accordingly, in such embodiments, the control sub-system 98 may instruct the power sub-system 80 to adjust electrical power supplied to its fluid power assembly 84, which adjusts the supply of pressurized actuation fluid from the fluid power assembly 84 to the well system equipment (process block 190). For example, the control sub-system 98 may instruct the power sub-system 80 to supply pressurized actuation fluid to an open fluid port 71A on a fluid valve 28 to transition the fluid valve 28 toward its open state and to supply pressurized actuation fluid to a close fluid port 71B on the fluid valve 28 to transition the fluid valve 28 toward its closed state. As another example, the control sub-system 98 may instruct the power sub-system 80 to supply actuation fluid with a lower fluid pressure to a fluid pump 50 to transition the fluid pump 50 toward a lower pumping rate state, to supply actuation fluid with a higher fluid pressure to transition the fluid pump 50 toward a higher pumping rate state, and to cease supplying pressurized actuation fluid to the fluid pump 50 to transition the fluid pump 50 to a non-pumping state.

In any case, the control sub-system 98 may then determine whether a corresponding equipment sensor 106A indicates that the well system equipment has achieved its target equipment state in the control action step (decision block 176). In particular, as described above, the control sub-system 98 may receive feedback from an equipment sensor 106A that is indicative of a current equipment state via one or more sensor signals 110. Accordingly, to determine whether a target equipment state has been achieved, the control sub-system 98 may determine whether a current equipment state of the well system equipment indicated by a corresponding equipment sensor 106A matches its target equipment state in the control action step.

Since well system equipment often does not change equipment state instantaneously, the control sub-system 98 may utilize a sensor timeout (e.g., time threshold). In particular, in some embodiments, a sensor timeout associated with an equipment sensor 106A may be set based on (e.g., to match or slightly longer than) the time (e.g., duration) expected to transition corresponding well system equipment from its current equipment state to its target equipment state in the control action step. However, to facilitate more conservatively accounting for equipment and/or environmental variations, in other embodiments, a sensor timeout associated with an equipment sensor 106A may be set based on the time expected to transition corresponding well system equipment from a first extreme equipment state to a second (e.g., opposite) equipment state. For example, a sensor timeout associated with an equipment sensor 106A that corresponds with a fluid valve 28 may be set based on the time expected to transition the fluid valve 28 from its fully open state to its fully closed state, or vice versa. As another example, a sensor timeout associated with an equipment sensor 106A that corresponds with a fluid pump 50 may be set based on the time expected to transition the fluid pump 50 from its non-pumping (e.g., off) state to its maximum pumping rate (e.g., on) state, or vice versa.

In any case, the control sub-system 98 may determine whether a corresponding sensor timeout has been reached (decision block 178) and continue checking whether the equipment sensor 106A indicates that the well system equipment has achieved its target equipment state until the sensor timeout is reached (arrow 191). In particular, to reduce the likelihood of producing further issues in the well system 10, in some embodiments, the control sub-system 98 may presume that the well system equipment is not able to achieve its target equipment state when the equipment sensor 106A does not indicate that the target equipment state has been achieved before the sensor timeout is reached and, thus, cease performance of the operation.

However, as discussed above, a faulty equipment sensor 106A may feedback an improper equipment state. In other words, in some instances, feedback from an equipment sensor 106A may indicate that corresponding well system equipment has not been achieved its target equipment state when the well system equipment has in fact achieved its target equipment state due to the equipment sensor 106A being faulty.

Accordingly, in other embodiments, the control sub-system 98 may presume that the equipment sensor 106A associated with the well system equipment is faulty when a corresponding sensor timeout is reached, but corresponding sensor feedback indicates that the well system equipment has not achieved its target equipment state. In other words, in such embodiments, the control sub-system 98 may presume that the well system equipment has achieved its target equipment state once the sensor timeout is reached (e.g., elapses) and continue accordingly. That is, in such embodiments, the control sub-system 98 may determine that the well system equipment has achieved its target equipment state at the earlier of sensor feedback from a corresponding equipment sensor 106 indicating that the well system equipment has achieved its target equipment state and the sensor timeout being reached (e.g., elapsing).

However, to better distinguish between a faulty equipment sensor 106A and faulty well system equipment and, thus, reducing unnecessary work stoppages, in other embodiments, the control sub-system 98 may determine whether the target equipment state of the well system equipment can be secondarily confirmed (decision block 184) and cease performance of the operation only if the target equipment state cannot be secondarily confirmed (process block 186). In particular, in some such embodiments, the control sub-system 98 may secondarily confirm whether the target equipment state has been achieved based on feedback from fluid parameter sensors 106B in the well system 10 and/or operator feedback.

Figure 6:
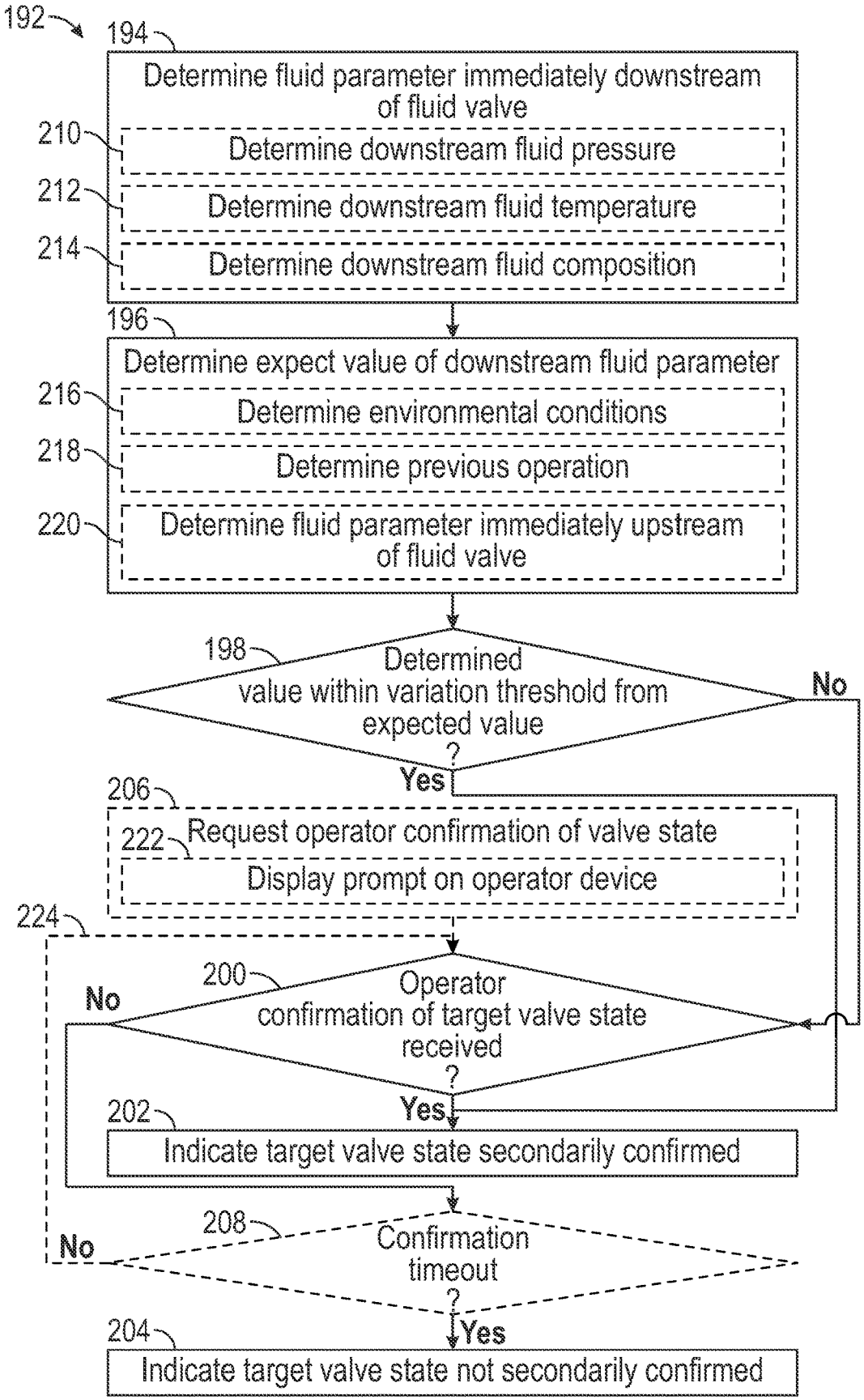
FIG. 6 is a flow diagram describing an example of a process for secondarily confirming achievement of a target valve state, in accordance with an embodiment of the present disclosure.

To help illustrate, an example of a process 192 for secondarily confirming whether a fluid valve 28 has achieved its target valve state is described in FIG. 6. Generally, the process 192 includes determining a fluid parameter immediately downstream of a fluid valve (process block 194), determining an expected value of the downstream fluid parameter (process block 196), determining whether the determined fluid parameter value is within a variation threshold from the expected value (decision block 198), and determining whether a confirmation from an operator that the fluid valve has achieved its target valve state has been received (decision block 200). Additionally, when the determined fluid parameter value is within the variation threshold from the expected value and/or when operator confirmation that the fluid valve has achieved its target state has been received, the process 192 generally includes indicating that the target valve state has been secondarily confirmed (process block 202). Furthermore, when the determined fluid parameter is not within the variation threshold from the expected value and operator confirmation that the fluid valve has achieved its target state has not been received, the process 192 generally includes indicating that the target valve state is not secondarily confirmed (process block 204).

However, it should be appreciated that the example process 192 is merely intended to be illustrative and not limiting. In particular, in other embodiments, depicted process blocks may be performed in a different order. For example, in other embodiments, the expected value of the downstream fluid parameter may be determined before the fluid parameter immediately downstream of the fluid valve is determined.

Additionally, in other embodiments, a process 192 for secondarily confirming whether a fluid valve 28 has achieved it target valve state may omit one or more of the depicted process blocks and/or one or more depicted decision blocks. For example, in other embodiments, the process 192 may only secondarily confirm whether the target valve state has been achieved based on operator confirmation and, thus, not include determining the fluid parameter immediately downstream of the fluid valve, determining the expected value of the downstream fluid parameter, or determining whether the determined fluid parameter value is within the variation threshold from the expected value. Alternatively, in other embodiments, the process 192 may only secondarily confirm whether the target valve state has been achieved based on feedback from fluid parameter sensors and, thus, not include determining whether operator confirmation that the fluid valve has achieved its target valve state has been received.

Furthermore, in some embodiments, a process 192 for secondarily confirming whether a fluid valve 28 has achieved it target valve state may include one or more additional process blocks and/or one or more additional decision blocks. For example, in some embodiments, the process 192 may additionally include requesting operator confirmation of a current valve state of the fluid valve (process block 206). As another example, when operator confirmation that the fluid valve has achieved its target state has not been received, in some embodiments, the process 192 may additionally include determining whether a confirmation timeout has been reached (decision block 208).

Moreover, in some embodiments, a process 192 for secondarily confirming whether a fluid valve 28 has achieved it target valve state may be performed at least in part by executing instructions stored in one or more tangible, non-transitory, computer-readable media, such as control sub-system memory 116, using processing circuitry, such as one or more control sub-system processors 114. In other words, in some embodiments, the process 192 may be performed at least in part by a control sub-system 98, such as a distributed control sub-system 98A (e.g., central controller 118 and multiple operator devices 120), of a well system 10.

Accordingly, to secondarily confirm whether a fluid valve 28 in a well system 10 has achieved its target valve state, a control sub-system 98 may determine a fluid parameter immediately downstream from the fluid valve 28 based on sensor feedback (e.g., one or more sensor signals 110) received from one or more fluid parameter sensors 106B disposed immediately downstream of the fluid valve 28 (e.g., with no other fluid valves 28 therebetween) (process block 194). In particular, in some embodiments, the control sub-system 98 may determine a fluid pressure immediately downstream of the fluid valve 28 (process block 210), a fluid temperature immediately downstream of the fluid valve 28 (process block 212), and/or a fluid composition immediately downstream of the fluid valve (process block 214).

In any case, the control sub-system 98 may additionally determine an expected value of the fluid parameter immediately downstream of the fluid valve (process block 196) and determine whether the determined fluid parameter value is within a variation threshold form the expected value (decision block 198). In particular, in some embodiments, an expected value of an immediately downstream fluid parameter may be predetermined, for example, and stored in control sub-system memory 116.

However, in other embodiments, the control sub-system 98 may adaptively determine the expected value of a fluid parameter immediately downstream of the fluid valve 28. In particular, in some such embodiments, the control sub-system 98 may determine environmental conditions and determine the expected value of an immediately downstream fluid parameter accordingly (process block 216). For example, when the target valve state is a closed state, the control sub-system 98 may determine the expected fluid temperature immediately downstream of the fluid valve 28 based at least in part on environmental temperature.

Additionally, in some such embodiments, the control sub-system 98 may determine previous operation of the well system 10 and determine the expected value of a fluid parameter immediately downstream of the fluid valve 28 accordingly (process block 218). For example, when the target valve state is a closed state, the control sub-system 98 may determine the expected fluid pressure immediately downstream of the fluid valve 28 based at least in part on the fluid pressure of fluid flowed through the fluid valve 28 during a previous operation. As another example, when the target valve state is a closed state, the control sub-system 98 may determine the expected fluid composition immediately downstream of the fluid valve 28 based at least in part on the fluid composition of fluid flowed through the fluid valve 28 during a previous operation. As a further example, when the target valve state is a closed state, the control sub-system 98 may determine the expected fluid temperature immediately downstream of the fluid valve 28 based at least in part on the fluid temperature of fluid flowed through the fluid valve 28 during a previous operation.

Furthermore, in some such embodiments, the control sub-system 98 may determine a fluid parameter immediately upstream from the fluid valve 28 and determine the expected value of the immediately downstream fluid parameter accordingly (process block 220). In other words, in such embodiments, the control sub-system 98 may determine the expected value of an immediately downstream fluid parameter based at least in part on sensor feedback (e.g., one or more sensor signals 110) received from one or more fluid parameter sensors 106B disposed immediately upstream of the fluid valve 28 (e.g., with no other fluid valves 28 therebetween). For example, when the target valve state is an open state, the control sub-system 98 may determine the expected value of fluid pressure immediately downstream from the fluid valve 28 based at least in part on fluid pressure immediately upstream from the fluid valve 28. As another example, when the target valve state is an open state, the control sub-system 98 may determine the expected value of fluid temperature immediately downstream from the fluid valve 28 based at least in part on fluid temperature immediately upstream from the fluid valve 28. As a further example, when the target valve state is an open state, the control sub-system 98 may determine the expected value of fluid composition immediately downstream of the fluid valve 28 based at least in part on the fluid composition immediately upstream of the fluid valve 28.

In any case, although a determined value of an immediately downstream fluid parameter should be relatively close to a corresponding expected value when the fluid valve 28 has achieved its target state, the variation threshold may be set to account for process, equipment, and/or environmental variations. For example, when the target valve state is an open state, a variation threshold associated with an immediately downstream fluid pressure may be set to account for pressure change that may occur as fluid flows through the fluid valve 28. As another example, a variation threshold associated with an immediately downstream fluid composition may account for materials that may be inadvertently introduced as fluid flows through the fluid valve 28, for example, due to corrosion or erosion of the fluid valve 28. As a further example, a variation threshold associated with an immediately downstream fluid temperature may be set to account for the effect environmental temperature may have on the temperature of fluid within the well system 10. Nevertheless, in more conservative embodiments, a variation threshold may be set to force the determined value of the immediately downstream fluid parameter to match the expected value, for example, when the expected value is already determined to account for process, equipment, and/or environmental variations.

In any case, the control sub-system 98 may additionally determine whether an operator confirmation that the fluid valve 28 has achieved its target valve state has been received (decision block 200). In particular, in some embodiments, an operator may confirm a current valve state of the fluid valve 28 from their operator device 120 and, thus, the control sub-system 98 may determine whether the fluid valve 28 has achieved its target valve state based on whether the operator confirmed valve state matches the target valve state. As described above, to facilitate operator confirmation of its current valve state, in some embodiments, a fluid valve 28 may have a visual indicator 112, such as a flag, attached to a valve actuator such that the visual indicator 112 changes positions (e.g., orientation) as the fluid valve 28 changes to different valve states. Additionally, as described above, to facilitate remote visual confirmation, in some embodiments, an optical sensor 106C may capture an image or video of the fluid valve 28, which the control sub-system 98 can then display, for example, on an operator device 120.

Accordingly, to facilitate expediting operator confirmation and, thus, well system operational efficiency, in some embodiments, the control sub-system 98 may explicitly request that an operator confirm (e.g., return) the current valve state of the fluid valve 28 (process block 206). In particular, in some such embodiments, the control sub-system 98 may display a prompt on the operator's operator device 120 that requests that the operator confirm the current valve state.

In any case, when the value of the determined immediately downstream fluid parameter is not within the variation threshold and operator confirmation of achievement of the target valve state has not been received, the control sub-system 98 may indicate that the target valve state has not been secondarily confirmed (process block 204). Accordingly, returning to the process 172 of FIG. 5, when achievement of the target equipment state has not been secondarily confirmed and the sensor timeout has elapsed, in some embodiments, the control sub-system 98 may cease performance of the operation (process block 186).

However, returning to the process 192 of FIG. 6, to provide an operator a reasonable time to respond, in some embodiments, the control sub-system 98 may utilize a confirmation timeout (e.g., time threshold) and only indicate that the target valve state has not been secondarily confirmed once the confirmation timeout has been reached (e.g., elapsed). In other words, in such embodiments, the control sub-system 98 may determine whether a confirmation timeout has been reached (decision block 208) and continue waiting for operator confirmation until the confirmation timeout is reached (arrow 224).

In fact, to facilitate balancing the amount of time provided for operator confirmation against efficient performance, in some such embodiments, the duration of the confirmation timeout may match the duration of a sensor timeout, which is associated with an equipment sensor 106A that corresponds with the fluid valve 28, and the control sub-system 98 may concurrently run the confirmation timeout and the sensor timeout. In other words, in such embodiments, the control sub-system 98 may begin attempting to secondarily confirm achievement of the target valve state while waiting for the equipment sensor 106A to confirm achievement of the target valve state. Nevertheless, in other embodiments, the control sub-system 98 may only start the confirmation timeout after the sensor timeout has been reached and, thus, only attempt to secondarily confirm achievement of the target valve state after an equipment sensor 106A is unable to confirm achievement of the target valve state.

In any case, when the value of the determined immediately downstream fluid parameter is within the variation threshold and/or the operator has confirmed achievement of the target valve state, the control sub-system 98 may indicate that the target valve state has been secondarily confirmed (process block 202). Accordingly, returning to the process 172 of FIG. 5, when the sensor timeout has elapsed, but achievement of the target equipment state has been secondarily confirmed, in some embodiments, the control subsystem 98 may indicate that the equipment sensor 106A corresponding with the well system equipment is potentially faulty (process block 188). For example, the control subsystem 98 may notify an operator of a potentially faulty equipment sensor 106A by displaying a message on their operator device 120 (process block 226).

In any case, once achievement of the target equipment state in accordance with the control action step is confirmed, the control sub-system 98 may determine whether any control action steps remain in the operation (decision block 180) and, if so, automatically perform a next control action step in the same manner (arrow 228). Once there are no control action steps remaining, the control sub-system 98 may indicate that performance of the operation is complete (process block 182). Nevertheless, to facilitate proper and efficient coordination between operations performed by different operators in the manner described above, in some embodiments, the control sub-system 98 may request that a corresponding operator explicitly confirm completion of the operation, for example, via a prompt on their operator device 120 (process block 230). In this manner, a control subsystem 98 may automatically control well system equipment to automatically perform an operation in a well system 10, for example, with no or minimal operator input or guidance, which, at least in some instances, may facilitate reducing operator error and, thus, improving operational efficiency (e.g., production time) of the well system 10.

Returning to the process 130 of FIG. 4, once an operation is performed, the control sub-system 98 may determine whether any more operations are to be performed in the well system 10 (e.g., in accordance with an operation schedule 124) and, if so, wait for a request to perform an operation before proceeding in the same manner (arrow 232). Once there are no more operations to be performed in the well system 10, the control sub-system 98 may place a lockout on all the operators to block the operators from subsequently and, thus, improperly controlling operation of well system equipment from their operator devices 120 (process block 144).

Moreover, as described above, since multiple different operator groups may perform operations around a well system 10, in some embodiments, an operation log 126 may be kept, for example, in control sub-system memory 116. In other words, in such embodiments, the control sub-system 98 may maintain an operation log 126 during the process 130 of coordinating operations in the well system 10. In particular, the control sub-system 98 may use the operation log 126 to track when performance of the operator's next operation was requested, when the different operator confirmed completion of their preceding operation, and when performance of the operator's next operation started. Merely as an illustrative, non-limiting example, the operation log 126 may track when an operator (e.g., fracturing operator and/or well owner's operator) requested performance of a hydraulic fracturing operation, when a tool operator confirmed completion of a perforation operation, and when the hydraulic fracturing operation began performance, for example, in addition to when the operator finalized or re-confirmed their request.

Accordingly, in such embodiments, if an issue that requires corrective action occurs in the well system 10, the corresponding operation log 126 may be referenced to identify a potential coordination breakdown that caused the issue, for example, to help avoid the issue in the future and/or to assign responsibility. Merely as an illustrative, non-limiting example, if a working (e.g., swab or master) valve is inadvertently closed on a conveyance line 44 during a hydraulic fracturing operation, the operation log 126 may be consulted to confirm whether performance of the hydraulic fracturing operation started after a tool operator confirmed completion of a corresponding perforation operation and, if so, that the issue resulted due to the tool operator improperly confirming completion of the perforation operation. In this manner, the techniques described in the present disclosure facilitate properly and efficiently coordinating operations of different operator groups around a well system, which, at least in some instances, may facilitate improving operational efficiency (e.g., production time) of the well system, for example, at least in part by minimizing operator error while accounting for the actual relationship between the different operator groups.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

In particular, although useful for coordinating multiple different operator groups that perform operations on the same well 14 and, thus, described in that manner, the techniques of the present disclosure may nevertheless be used with a single operator group or even a single operator. For example, in some such embodiments, a control subsystem 98 in a well system 10 may simply enable an operator to request performance of an operation and immediately request that the operator finalize or re-confirm their request before permitting performance of the operation. Additionally, in some such embodiments, a control subsystem 98 in a well system 10 may use an operation log 126 to track when an operator requested performance of their next operation as well as when the operator finalized or re-confirmed their request to perform their next operation, for example, in addition to when the operator confirmed completion of their preceding operation and/or when the operator actually began performing their next operation.

What is claimed is:

1. A method of coordinating performance of operations in a well system, comprising:

receiving, using a central controller of a control subsystem, a request to perform a next operation associated with a first operator that includes changing well system equipment from a current equipment state to a target equipment state from a first operator device that is assigned to and associated with the first operator;

determining, using the central controller, whether completion confirmation of a preceding operation associated with a second operator has been received from a second operator device that is assigned to and associated with the second operator;

in response to determining that the completion confirmation of the preceding operation associated with the second operator has not been received from the second operator device, blocking, using the central controller, the first operator from performing the next operation to change the well system equipment from the current equipment state to the target equipment state from the first operator device; and in response to determining that the completion confirmation of the preceding operation associated with the second operation has been received from the second operator device, permitting, using the central controller, performance of the next operation associated with the first operator at least in part by enabling the well system equipment to be changed from the current equipment state to the target equipment state from the first operator device.

2. The method of claim 1, wherein:

receiving the request to perform the next operation comprises receiving a request to perform a hydraulic fracturing operation associated with a fracturing operator, wherein the hydraulic fracturing operation is to be performed while a swab valve on a fracturing tree is in a closed state; and determining whether the completion confirmation of the preceding operation has been received comprises determining whether completion confirmation of a perforation operation associated with a tool operator, wherein the perforation operation is to be performed while the swab valve on the fracturing tree is in an open state.

3. The method of claim 1, wherein permitting performance of the next operation associated with the first operator comprises:

enabling the first operator to finalize the request to perform the next operation via the first operator device;

in response to determining that the first operator has not finalized the request to perform the next operation, maintaining a lockout on the first operator to block the first operator from adjusting operation of the well system equipment from the first operator device; and in response to determining that the first operator has finalized the request to perform the next operation, removing a lockout from the first operator.

4. The method of claim 1, wherein permitting performance of the next operation associated with the first operator comprises:

enabling the first operator to finalize the request to perform the next operation via the first operator device;

in response to determining that the first operator has not finalized the request to perform the next operation, canceling the request to perform the next operation; and in response to determining that the first operator has finalized the request to perform the next operation, performing the next operation associated with the first operator by instructing the well system to change the well system equipment from the current equipment state to the target equipment state.

5. The method of claim 4, wherein performing the next operation associated with the first operator comprises:

instructing the well system to transition an isolating valve that is fluidly coupled between a fracturing fluid source and a fracturing tree from a closed state to an open state; and after the isolating valve has achieved the open state, instructing the well system to transition a working valve on the fracturing tree from another closed state to another open state.

6. The method of claim 5, wherein:

performing the next operation associated with the first operator comprises determining whether the isolating valve has achieved the open state based on sensor feedback from an equipment sensor associated with the isolating valve before a sensor timeout elapses;

instructing the well system to transition the working valve from the another closed state to the another open state comprises instructing the well system to transition the working valve from the another closed state to the another open state at an earlier of the sensor feedback indicating that the isolating valve has achieved the open state and the sensor timeout elapsing; and indicating that the equipment sensor associated with the isolating valve is potentially faulty in response to determining that the sensor timeout elapsed.

7. The method of claim 5, wherein:

performing the next operation associated with the first operator comprises:

confirming whether the isolating valve has achieved the open state based on first sensor feedback received from an equipment sensor associated with the isolating valve before a sensor timeout elapses; and secondarily confirming whether the isolating valve has achieved the target equipment state based on second sensor feedback from a fluid parameter sensor in the well system, feedback from the first operator or another operator, or both after the sensor timeout elapses; and instructing the well system to transition the working valve on the fracturing tree from the another closed state to the another open state comprises instructing the well system to transition the working valve from the another closed state to the another open state in response to confirmation that the isolating valve has achieved the open state.

8. The method of claim 5, wherein:

instructing the well system to transition the isolating valve from the closed state to the open state comprises instructing the well system to supply pressurized actuation fluid to a fluid port on a fluid-powered valve actuator of the isolating valve; and instructing the well system to transition the working valve from the another closed state to the another open state comprises instructing the well system to supply pressurized actuation fluid to an another fluid port on another fluid-powered valve actuator of the working valve.

9. A well system, comprising:

well system equipment;

a power sub-system configured to selectively power the well system equipment; and a control sub-system communicatively coupled to the power sub-system, wherein the control sub-system comprises:

a first operator device configured to be assigned to and associated with a first operator, wherein the first operator device is configured to enable the first operator to request performance of a next operation in the well system that includes changing the well system equipment from a current equipment state to a target equipment state;

a second operator device configured to be assigned to and associated with a second operator, wherein the second operator device is configured to enable the second operator to confirm completion of a preceding operation in the well system; and a central controller communicatively coupled to the first operator device and the second operator device via a communication network, wherein the central controller is configured to permit performance of the next operation associated with the first operator only after the second operator has confirmed completion of the preceding operation.

10. The well system of claim 9, wherein:

the first operator device comprises:

a first electronic display configured to display a visual representation of the current equipment state, the target equipment state, or both; and a first user input device configured to enable a fracturing operator to request performance of a hydraulic fracturing operation; and the second operator device comprises:

a second electronic display configured to display a prompt requesting that a tool operator confirm completion of a perforation operation; and a second user input device configured to enable the tool operator to respond to the prompt.

11. The well system of claim 9, wherein:

the first operator device comprises a first mobile device, a first tablet computer, or a first laptop computer; and the second operator device comprises a second mobile device, a second tablet computer, or a second laptop computer.

12. The well system of claim 9, wherein:

the first operator device is configured to enable the first operator to finalize the request to perform the next operation in the well system after the second operator has confirmed completion of the preceding operation; and the central controller is configured to:

maintain a lockout on the first operator to block the first operator from adjusting operation of the well system equipment from the first operator device before the second operator has confirmed completion of the preceding operation and before the first operator finalizes the request to perform the next operation; and remove the lockout from the first operator after the second operator has confirmed completion of the preceding operation and after the first operator finalizes the request to perform the next operation.

13. The well system of claim 9, wherein:

the first operator device is configured to enable the first operator to finalize the request to perform the next operation in the well system after the second operator has confirmed completion of the preceding operation; and the control sub-system is configured to:

cancel the request to perform the next operation in the well system when the first operator does not finalize the request to perform the next operation; and perform the next operation in the well system at least in part by instructing the power sub-system to adjust power supplied to the well system equipment when the first operator finalizes the request to perform the next operation.

14. The well system of claim 13, wherein, to perform the next operation in the well system, the control sub-system is configured to:

instruct the power sub-system to power an isolating valve fluidly coupled between a fracturing fluid source and a fracturing tree such that the isolating valve transitions from a closed state to an open state; and after the isolating valve has achieved the open state, instruct the power sub-system to power a working valve on the fracturing tree such that the working valve transitions from another closed state to another open state.

15. The well system of claim 14, comprising an equipment sensor communicatively coupled to the control sub-system, wherein:

the equipment sensor is configured to provide sensor feedback indicative of the current equipment state of the isolating valve; and to perform the next operation in the well system, the control sub-system is configured to:

determine whether the sensor feedback indicates that the isolating valve achieved the open state before a sensor timeout is reached;

at an earlier of the sensor feedback indicating that the isolating valve has achieved the open state and the sensor timeout being reached, automatically instruct the power sub-system to power the working valve such that the working valve transitions from the another closed state to the another open state; and indicate that the equipment sensor is potentially faulty if the sensor timeout is reached.

16. The well system of claim 14, wherein:

the isolating valve comprises:

a valve body that defines a fluid bore;

a flow control component disposed within the fluid bore;

a valve actuator that extends through the valve body and secured to the flow control component, wherein the valve actuator is configured to actuate the flow control component to transition the isolating valve between another open state and another closed state; and a visual indicator attached to the valve actuator such that the visual indicator extends out from the valve actuator, wherein the visual indicator is configured to move along with the valve actuator to provide the first operator an exaggerated visual indication of the current equipment state of the isolating valve; and to perform the next operation associated with the first operator, the control sub-system is configured to:

determine whether confirmation that the isolating valve has achieved the open state has been received from the first operator or another operator; and automatically instruct the power sub-system to power the working valve such that the working valve transitions from the another closed state to the another open state once confirmation that the isolating valve has achieve the open state has been received from the first operator or the another operator.

17. A tangible, non-transitory, computer-readable media storing instructions executable by processing circuitry of a control sub-system in a well system, wherein the instruction comprise instructions to:

instruct, using the processing circuitry, the well system to transition a fluid valve from a first current state to a first target state;

determine, using the processing circuitry, whether sensor feedback received from an equipment sensor corresponding with the fluid valve indicates that the fluid valve has achieved the first target state;

determine, using the processing circuitry, whether a sensor timeout associated with the equipment sensor of the fluid valve has elapsed; and at an earlier of the sensor feedback indicating that the fluid valve has achieved the first target state and the sensor timeout elapsing, instruct, using the processing circuitry, the well system to transition other well system equipment from a second current state to a second target state.

18. The tangible, non-transitory, computer-readable media of claim 17, wherein:

the instructions to instruct the well system to transition the fluid valve from the first current state to the first target state comprise instructions to instruct the well system to transition a swab valve on a fracturing tree from a first open state to a first closed state; and the instructions to instruct the well system to transition the other well system equipment from the second current state to the second target state comprises instructions to instruct the well system to transition an isolating valve fluidly coupled between a fracturing fluid source and the fracturing tree from a second closed state to a second open state.

19. The tangible, non-transitory, computer-readable media of claim 17, wherein:

the instructions to instruct the well system to transition the fluid valve from the first current state to the first target state comprise instructions to instruct the well system to transition an isolating valve fluidly coupled between a fracturing fluid source and a fracturing tree from a first closed state to a first open state; and the instructions to instruct the well system to transition the other well system equipment from the second current state to the second target state comprises instructions to instruct the well system to transition a working valve on the fracturing tree from a second closed state to a second open state.

20. The tangible, non-transitory, computer-readable media of claim 17, wherein the instructions to instruct the well system to transition the fluid valve from the first current state to the first target state comprises instructions to instruct a power sub-system in the well system to adjust supply of pressurized actuation fluid to a fluid-powered valve actuator of the fluid valve, wherein the fluid-powered valve actuator is coupled to a flow control component of the fluid valve.

* * * * *